US009865925B2

(12) United States Patent
Mitchell et al.

(10) Patent No.: US 9,865,925 B2
(45) Date of Patent: Jan. 9, 2018

(54) LOW-PROFILE CAVITY BROADBAND ANTENNAS HAVING AN ANISOTROPIC TRANSVERSE RESONANCE CONDITION

(71) Applicant: U.S. Army Research Laboratory, Washington, DC (US)

(72) Inventors: Gregory A. Mitchell, Olney, MD (US); Wasyl Wasylkiwskyj, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 278 days.

(21) Appl. No.: 14/593,380

(22) Filed: Jan. 9, 2015

(65) Prior Publication Data

US 2016/0204511 A1 Jul. 14, 2016

(51) Int. Cl.

| | |
|---|---|
| ***H01Q 13/02*** | (2006.01) |
| ***H01Q 19/06*** | (2006.01) |
| ***H01Q 19/10*** | (2006.01) |
| ***H01Q 9/04*** | (2006.01) |

(52) U.S. Cl.

CPC ..... *H01Q 9/0407* (2013.01); *H01Q 13/02* (2013.01); *H01Q 19/06* (2013.01); *H01Q 19/10* (2013.01)

(58) Field of Classification Search

CPC ..... H01Q 9/0407; H01Q 19/06; H01Q 19/10; H01Q 13/18; H01Q 1/38; H01Q 1/28; H01Q 1/286; H01Q 13/06; H01Q 13/02

See application file for complete search history.

(56) References Cited

U.S. PATENT DOCUMENTS 3,177,491 A * 4/1965 Rateau ..... H01Q 13/18 343/786
5,977,914 A * 11/1999 Harano ..... H01Q 3/16 343/700 MS
6,023,244 A * 2/2000 Snygg ..... H01Q 1/246 343/700 MS (Continued)

OTHER PUBLICATIONS

U.S. Appl. No. 14/593,292, filed Jan. 9, 2015.

(Continued)

*Primary Examiner* — Dameon E Levi
*Assistant Examiner* — Jennifer F Hu
(74) *Attorney, Agent, or Firm* — Eric Brett Compton

(57) ABSTRACT

Embodiments of the present invention relate to low-profile broadband antennas having an anisotropic traverse resonance condition. One important aspect of the invention is the incorporation of an anisotropic high index medium material, at least partially loaded within the cavity, which is configured to maintain a constant resonance frequency of the antenna. A low-profile cavity antenna may comprise: an aperture defining an opening to a cavity; an interior space defined by the cavity which is formed of a flat bottom wall defining a ground plane, and a pair of spaced-apart, lateral sidewalls extending away from the flat bottom wall in opposite directions toward the aperture; and an anisotropic high index medium material, at least partially loaded within the cavity, configured to maintain a constant resonance frequency of the antenna. The lateral sidewalls may extend from opposing sides of the flat bottom wall perpendicularly or with an outwardly taper.

21 Claims, 17 Drawing Sheets

(a) top, and (b) side views (c) isometric view

(56) References Cited

U.S. PATENT DOCUMENTS

| | | | | |
|---|---|---|---|---|
| 6,075,485 | A * | 6/2000 | Lilly | H01Q 1/38 343/700 MS |
| 6,281,858 | B1 | 8/2001 | Jennetti et al. | |
| 7,595,765 | B1 * | 9/2009 | Hirsch | H01Q 1/28 343/789 |
| 9,448,305 | B2 * | 9/2016 | Bowers | G01S 13/887 |
| 2002/0180654 | A1 * | 12/2002 | Acher | H01Q 1/125 343/757 |
| 2003/0020655 | A1 * | 1/2003 | McKinzie, III | H01Q 1/38 343/700 MS |
| 2005/0099338 | A1 * | 5/2005 | Noro | H01Q 1/52 343/700 MS |
| 2005/0151695 | A1 * | 7/2005 | Chen | H01P 5/02 343/786 |
| 2005/0231436 | A1 * | 10/2005 | McLean | H01Q 13/0275 343/786 |
| 2006/0066467 | A1 * | 3/2006 | Kurihara | H01Q 17/008 342/1 |
| 2014/0043199 | A1 * | 2/2014 | Grange | H01Q 9/0428 343/843 |

OTHER PUBLICATIONS

Gregory Mitchell & Wasyl Wasylkiwskyj, in a conference presentation at the URSI National Radio Science meeting in Boulder, CO on Jan. 9, 2014 (abstract titled "Low Profile Wide Band VHF/UHF Antenna" and slide presentation titled "Utilizing Metamaterials in the Design of a Low Profile UHF Antenna").

Gregory A. Mitchell, "Comparison of Anisotropic versus Isotropic Metamaterials in Low Profile UHF Antenna Design", ARL-TR-7012, report published by the U.S. Army Research Laboratory, Aug. 2014.

Wei Yan, Aixin Chen; Jiang, Tiehuq. Design of UHF Miniature Discone Antenna. Proceedings of 9th International Symposium on Antennas Propagation and EM Theory (ISAPE), 2010.

Aixin, Chen; Jiang, Tiehua; Chen, Zhizhang; Su, Donglin; Wei, Wenxuan; Zhang, Yanjun. A Wideband VHF/UHF Discone-Based Antenna. IEEE Antennas and Wireless Propagation Letters 2011, 10.

Chen, A.; Jiang, T.; Chen, Z.; Su, D. A Novel Low-Profile Wideband UHF Antenna. Progress in Electromagnetrics Research (PIER) 2011, 121, 75-88.

Lagarkov, A. N.; Semeneko, V. N.; Kisel, V. N.; Christyaev, V. A. Development and Simulation of Microwave Artifical Magnetic Composities Utilizing Non-magnetic Inclusion. Journal of Magnetism and Magnetic Materials 2003.

Maslovski, S.; Ikonen, P.; Kolmakov, I.; Tretyakov S. Artificial Magnetic Materials Based on the New Magnetic Particle Metasolenoid. Progress in Electromagnetics Research (PIER) 2005, 54, p. 61-81.

Baily, M. C. Broadband Half Wave Dipole. IEEE Trans. On Antennas and Propagation Apr. 1984, AP-32 (4).

Schelkunoff, S. A. Schelkunoff. Electromagnetic Waves. DuHamelH 1943, 9, Van Nostrand, New York., pp. 316-322.

Williamson, A. G..Analysis and Modeling of a Coaxial-line/Rectangular-waveguide Junction. IEEE Proceedings (Microwaves, Optics, and Antennas), vol. 129, Issue 5. Oct. 1982.

Wade, P. Rectangular Waveguide to Coax Transition Design. QEX, Nov./Dec. 2006.

David Pozar. Microwave Engineering. 3rd. ed., John Wiley and Sons, 2005, pp. 106-116 and 278-279.

* cited by examiner (a) top, and (b) side views (c) isometric view (a)

(b)

(a) top, and (b) side views (c) isometric view (a)

(b)

(a)

(b)

(a) top, and (b) side views (c) isometric view (a)

(b)

(a)

(b)

(c)

(a) top, and (b) side views (c) isometric view (a)

(b)

(c)

(a) top, and (b) side views (c) isometric view (a)

(b)

(c)

(a)

(b)

(a)

(b)

(c)

LOW-PROFILE CAVITY BROADBAND ANTENNAS HAVING AN ANISOTROPIC TRANSVERSE RESONANCE CONDITION

GOVERNMENT INTEREST

Government Interest—The invention described herein may be manufactured, used and licensed by or for the U.S. Government.

RELATED APPLICATION(S)

This patent application is related to U.S. patent application Ser. No. 14/593,292 filed Jan. 9, 2015, titled "Low-Profile, Tapered-Cavity Broadband Antennas." Herein incorporated by reference in its entirety.

BACKGROUND OF THE INVENTION

I. Field of the Invention

Embodiments of the present invention relate to broadband antenna, and more particularly, to low-profile cavity broadband antennas having an anisotropic traverse resonance condition.

II. Description of the Related Art

High index dielectric ceramics have been used to create low profile antennas at low UHF bands, for instance. However, these are generally bandwidth limited due to the fact that it is very difficult to match a high dielectric material over more than a narrow band. This stems from the fact that impedance is calculated as $Z_o=(\mu/\in)\hat{}0.5$ which becomes very small as $\in$ increases.

Techniques using double negative (DNG) metamaterials which mimic a perfect magnetic conductor (PMC) ground plane using a principle known as electro-band gap (EBG) have been considered. Using antenna image theory, a PMC ground plane allows an antenna to approach the ground plane without cancelling out its radiation pattern, however, PMC ground planes do not exist naturally. DNG materials yield a negative $\mu$ and $\in$, but again are very bandwidth limited. This is because currently metamaterials only exhibit these negative properties at a narrowband resonance. Therefore, theoretically a nearly infinitely thin antenna could be created using this technique, but not with wide bandwidth operational characteristics.

Thus, improvements to low-profile antennas would be useful.

BRIEF SUMMARY OF THE INVENTION

Embodiments of the present invention relate to broadband antenna, and more particularly, to low-profile broadband antennas having an anisotropic traverse resonance condition. One important aspect of the invention (although not the only) is the incorporation of an anisotropic high index medium material, at least partially loaded within the cavity, which is configured to maintain a constant resonant frequency of the antenna. The cavity may have an overall rectangular shape.

More particularly, according to various embodiments, a low-profile cavity antenna may comprise: an aperture defining an opening to a cavity; an interior space defined by the cavity which is formed of a flat bottom wall defining a ground plane, and a pair of spaced-apart, lateral sidewalls extending away from the flat bottom wall in opposite directions toward the aperture; and an anisotropic high index medium material, at least partially loaded within the cavity, which is configured to maintain a constant resonant frequency of the antenna.

The antenna embodiments are designed to provide broadband response in operation. For some applications, ultra high frequency (UHF) spectrum, from about 300 MHz to about 3 GHz, may be of importance (although, it will be appreciated that the inventions is not limited to such).

The anisotropic high index medium material may be provided on the flat bottom wall of the antenna cavity. In some embodiments, the anisotropic high index medium material is formed in the shape of a triangular prism. Although, other shapes are also possible.

In some embodiments, the lateral sidewalls are perpendicular extend from opposing sides of the flat bottom wall in substantially perpendicularly direction to the aperture. Or in other embodiment the lateral sidewalls extend from opposing sides of the flat bottom wall with an outwardly taper toward the aperture. The tapered shape of the tapered lateral sidewalls can be defined by a tangential equation, such as Equation 28 defined herein. The taper may be a linear, convex, or concave taper. Also, the cavity may further include a flange surrounding the aperture.

Depending on operation, the antenna may be feed with a just single input port. Or, in other embodiments, the antenna may be feed with two input port. By symmetrically feeding the two input port, more advantageous performance may be achieved in certain circumstances.

For some applications, embodiments of the antenna may be configured to provide at least 1.5 octaves of bandwidth with a positive realized gain from about 200-515 MHz, for instance.

According to one particular embodiment, a low-profile cavity antenna may comprise: a rectangular aperture defining an opening to a cavity; an interior space defined by the cavity which is formed of: a flat bottom wall defining a ground plane, a pair of spaced-apart, longitudinal sidewalls extending from opposing sides of the flat bottom wall substantially perpendicular to the aperture, and a pair of spaced-apart, lateral sidewalls being symmetric and extending toward the aperture from opposing sides of the flat bottom wall on opposite from where the longitudinal sidewalls extend; and an anisotropic high index medium material, at least partially loaded within the cavity, which is configured to maintain a constant resonant frequency of the antenna.

These and other embodiments are described in more detail below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. These embodiments are intended to be included within the following description and protected by the accompanying claims.

FIG. 15(*b*) shows the advantage of an symmetric over an asymmetric feed.

DETAILED DESCRIPTION OF THE INVENTION

The present invention provides low-profile cavity broadband antennas having an anisotropic traverse resonance condition. As mentioned above, one important aspect of the invention is the incorporation of an anisotropic high index medium material, at least partially loaded within the cavity. This advantageous feature enables the antenna to maintain a constant resonance frequency within the cavity.

In some embodiments, the cavity may have tapered lateral sidewalls. Although, results show that the shape of the cavity can be changed as needed with no degradation to the overall antenna performance through control of the permeability in the normal direction $\mu_z$.

Before describing embodiments of the present invention, this disclosure first details the derivation of a low profile cavity antenna by the inventors based on an anisotropic traverse resonance condition of a partially loaded cavity. This novel antenna cavity design is specifically designed to maintain a constant resonant frequency in the presence of anisotropic high index medium material.

Figure 1:
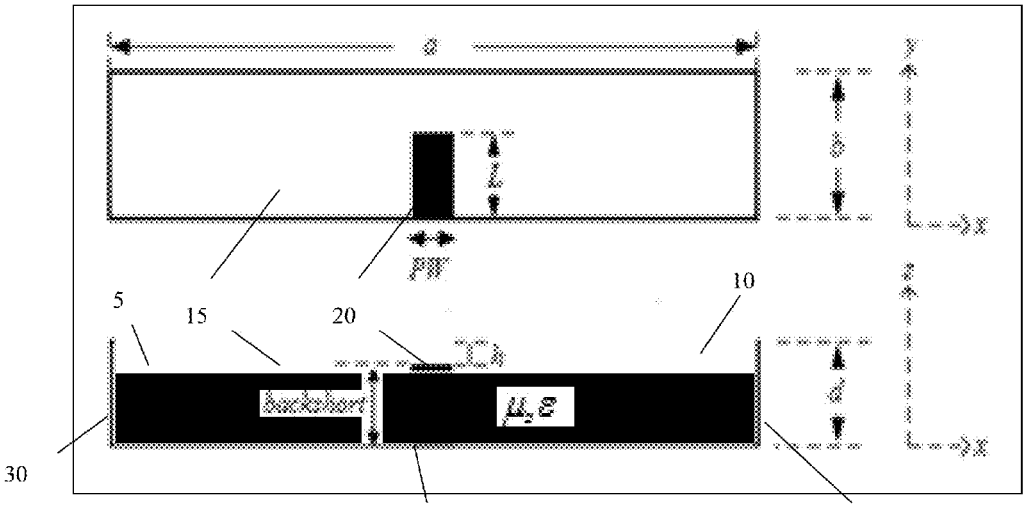
FIG. 1 shows an antenna having a rectangular radiating cavity partially loaded with an isotropic high index medium material, where FIG. 1(*a*) shows a top plan view, FIG. 1(*b*) shows a side view, FIG. 1(*c*) shows an isometric view of the antenna.
Figure 1:
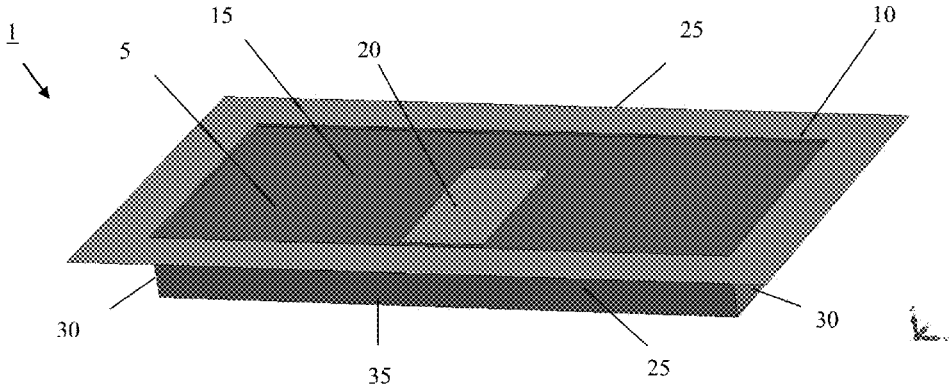

As a starting point, the inventors first began investigating an antenna having a rectangular radiating cavity. FIG. 1 shows an antenna 1 having a rectangular radiating cavity 5, where FIG. 1(*a*) shows a top plan view, FIG. 1(*b*) shows a side view, FIG. 1(*c*) shows an isometric view of the antenna.

As shown in FIG. 1, the antenna 1 includes rectangular radiating cavity 5 having a radiating aperture 10 of nominal dimensions a by b loaded with high index medium material 15. The radiating aperture 10 is the plane which defines the opening to the interior to the cavity 5. The rectangular cavity 5 is formed of a pair of spaced-apart longitudinal (long) sidewalls 25, a pair of spaced-apart lateral (short) sidewalls 30, and a flat bottom wall 35 defining an interior space. The width in the x-direction is a, the width in the y-direction is b, and the width in the z-direction is d.

The walls 25, 30, 35 of the rectangular cavity 5 have generally perpendicular (i.e., 90°) flat interfaces forming a "box-like" structure. The cavity 5 may be constructed of conducting metal and has been filled with an isotropic high index medium material 15 to reduce the size of the profile. The profile of the cavity 5 is defined as the physical distance between the aperture 10 and the bottom wall 35.

The bottom cavity wall 35 is generally considered the ground plane. It might be considered a perfect electric conductor (PEC) ground plane. In reality, though, there is no such thing as a PEC. It is only used as a theoretical construct; in actuality, the cavity would likely be metallic. Any metal material could be used to approximate the behavior of a PEC with the same results.

As apparent in FIG. 1(*b*), nearly the entire cavity 5 is filled with the high index medium material 15 with the cavity walls (25, 30, 35) surrounding the high index medium material 15. An amount of 19,723 $cm^3$ of material 15 was used for the antenna design in FIG. 1 or V=a*b*d.

The refractive index for a material is defined as $n=(\in_r*\mu_r)$ ^0.5 with permittivity $\in_r$ and permeability $\mu_r$. In general, a high index medium material may be considered any material with n>1 and is typical for many materials having $\in_r>1$ and/or $\mu_r>1$. To the extent possible, a material having the highest refractive index possible may be utilized.

Traditional isotropic materials, such as duroid ($\in_r=2.1$, $\mu_r=1$) or Rogers 6010 ($\in_r=10.2$, $\mu_r=1$), for example, available from the Rogers Corporation, can be used for material 15. These microwave laminates are ceramic-PTFE composites designed for electronic and microwave circuit applications requiring a high dielectric constant. As an isotropic material, its physical properties are the same (or nearly the same) in every direction. Thus, the impedance may be defined as $$Z_c = \sqrt{\mu_r/\varepsilon_r}\,.$$

Of course, various other known isotropic compositions for material 15 might also be used.

The electromagnetic field inside the cavity 5 is stimulated via a metallic rectangular probe port 20 disposed on top of the high index medium material 15 that is fed by a coaxial cable (not shown). The probe port 20 may be formed of metal of other conductor. It may be located a distance h from the aperture 10. The width (PW) and length (L) of the port 20 have been optimized to provide the best impedance match at the coaxial input (e.g., 50Ω).

This antenna design and simulations thereof were used as a starting point by the inventors. They demonstrate how loading a rectangular cavity 5 with a high index medium material 15 shifts the resonant frequency and creates instability in the impedance match. This instability is further highlighted with respect to FIGS. 2(*a*) and 2(*b*), discussed below. By contrast, as will be further explained, embodiments of the present invention provide a novel cavity design which circumvents this problem by maintaining a constant resonance frequency when loading with an anisotropic high index medium material.

Table 1 shows dimensions for simulations run by the inventors for evaluating the antenna geometry in FIG. 1. It is noted that all dimensions in this table are in inches except for the resonance frequency $f_r$. The back short dimension refers to the separation between the port 20 and the bottom wall 35 of the cavity 5.

TABLE 1

| back short | a | b | $f_r$ (MHz) | PW | d | L | h |
|---|---|---|---|---|---|---|---|
| $\lambda_r/4$ | $\lambda_o/2$ | a/2.25 | 200 | 4.3 | $\lambda_r/4$ + h | 8.5 | 0.12 |

The size of the aperture 10 in the x-direction here is designed to be $a=\lambda_o/2$ (i.e., half free-space wavelength) at 200 MHz, and the back short is $\lambda_r/4$ at the center frequency (350 MHz) of the frequency band of interest where:

$$\lambda_r = \frac{\lambda_o^{cf}}{\sqrt{0.5\,\varepsilon_r\mu_r - \left(\frac{\lambda_o^{cf}}{(2a)}\right)^2}} \tag{1}$$

$\lambda_o^{cf}$ is the free space wavelength at the center frequency, and $\lambda_r$ is wavelength inside the high index medium. The subscript r does not denote a direction; rather it is simply a subscript that is used to differentiate it from the free space wavelength ($\lambda_o$). In operational terms of the antenna, $\lambda_r$ can be considered the resonance wavelength. $\lambda_r/4$ inside the cavity will yield in-phase addition of the radiated wave and the reflected wave at the aperture. This in-phase addition will essentially double the radiated power if the feed maintains a good impedance match at the input. Equation 1 indicates that by increasing $\in_r$ and/or $\mu_r$, the value of $\lambda_r$ is reduced, which will serve to reduce the profile of the rectangular cavity since this is approximately $\lambda_r/4$ at 350 MHz.

Figure 2:
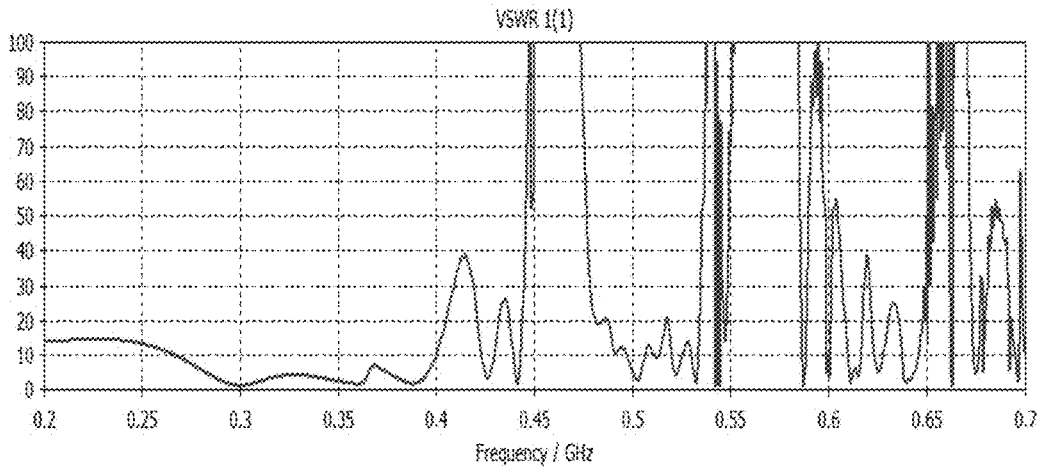
FIG. 2 shows simulated performance of the antenna shown in FIG. 1, where FIG. 2(*a*) and FIG. 2(*b*) show the voltage standing-wave-ratio (VSWR) and realized gain for the antenna, respectively.
Figure 2:
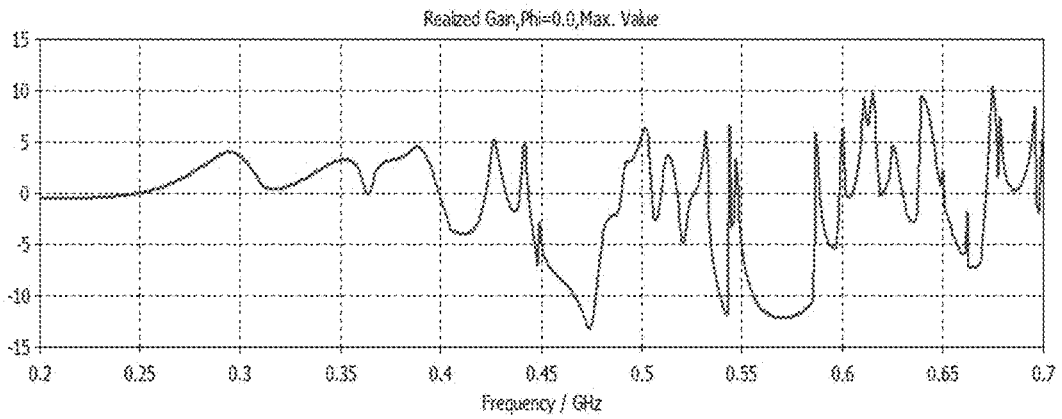

FIG. 2 shows simulated performance of the antenna shown in FIG. 1, where FIG. 2(*a*) and FIG. 2(*b*) show the voltage standing-wave-ratio (VSWR) and realized gain for the antenna, respectively.

As generally understood by one in the art, the VSWR is another way of looking at the impedance match at the input port to the antenna. A VSWR of 3:1 corresponds to −6 dB and 2:1 corresponds to −10 dB. The unstable nature of the VSWR indicates that there are several resonances operating within the rectangular cavity for these dimensions—which is expected because Equation 1 realizes that when $\mu_r$ and/or $\in_r$ of the material inside the rectangular cavity increases, the resonance frequency decreases. The resonance frequency is defined as $f_r=c_o/\lambda_r$. Here, $c_o$ is defined as the speed of light in a vacuum.

For the simulated performance, where the dielectric medium in the cavity has $\in_r=10$ and $\mu_r=1$, a=29.5"=$\lambda_o/2$ at 200 MHz, then $f_r$=63.25 MHz yielding unstable results for the VSWR and realized gain. Since additional resonances begin to operate at each octave, this means that every 63.25 MHz an additional resonance is introduced to the rectangular cavity so that at 200 MHz there are up to three resonances operating inside the rectangular cavity, and at 500 MHz there are as many as seven resonances.

The results of FIGS. 2(*a*) and 2(*b*) demonstrate that as more resonances begin to appear within the rectangular cavity, the performance of the antenna is severely degraded. Looking at the VSWR in FIG. 2(*a*) shows how poorly this antenna performs. A functional antenna is generally considered to have a VSWR of 3 or better. The antenna of FIG. 1 has a VSWR greater than 10 over much of the band making the antenna unusable. Portions of the band that have low VSWR are due to the tuning out of the reactance in the cavity by the probe, but that these portions are extremely narrowband. The increase in instability above 400 MHz is due to the fact that there are more resonances within the cavity.

Having multiple resonances will tend to interfere destructively making it very difficult to achieve a good impedance match over a wide bandwidth. The existence of multiple resonances is an unavoidable consequence of waveguide theory when introducing high index materials because they lower the resonance frequency of the cavity. The inventors believe that only the first resonance should operate over the frequency band because multiple resonances tend to interfere destructively. Therefore, they determined that $f_r$ would need to remain constant to ensure operation of only the lowest resonance at the frequency of operation.

The shape of the antenna cavity was then investigated. The inventors considered the geometry of a tapered rectangular cavity partially loaded with high index material. This was an initial approximation.

Figure 3:
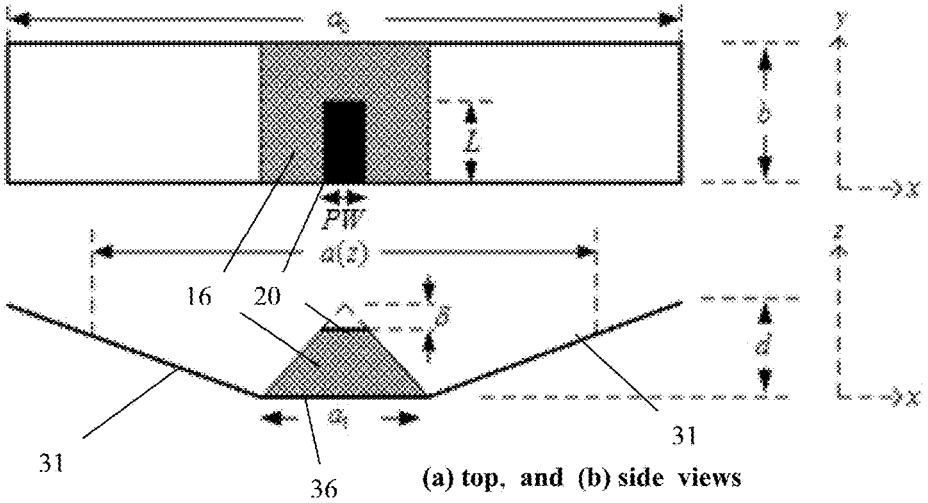
FIG. 3 shows an antenna having a linear tapered cavity partially loaded with a high index medium material, where FIG. 3(*a*) shows a top plan view, FIG. 3(*b*) shows a side view, FIG. 3(*c*) shows an isometric view of the antenna.
Figure 3:
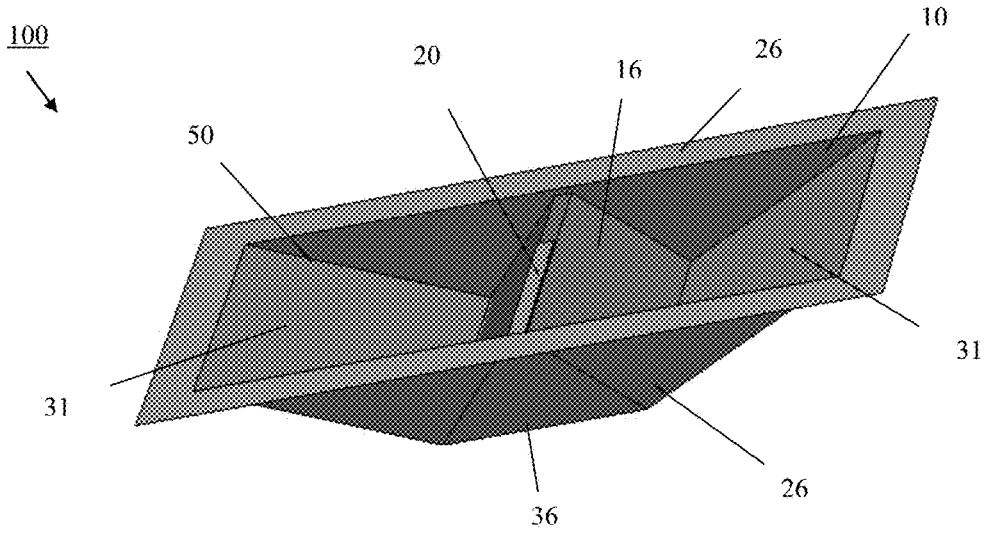

FIG. 3 is an illustration of an antenna 100 having a linear tapered antenna cavity 50 partially loaded with a high index material 16, where FIG. 3(*a*) shows a top plan view, FIG. 3(*b*) shows a side view, FIG. 3(*c*) shows an isometric view of the antenna.

The tapered cavity 50 is formed of a pair of spaced-apart longitudinal (long) sidewalls 26, a pair of spaced-apart laterally-tapered (short) sidewalls 31, and the flat bottom wall 36 defining an interior space.

The cavity 50 may have an overall rectangular shape. Here, the linear tapered cavity 50 has an overall length $a_0$ and width b with the flat bottom wall 36 having a length $a_1$ and the tapered sidewalls 31 tapering in such a way as to maintain a nearly constant $f_r$. The width b is constant. As apparent, the tapered sidewalls 31 have a linear taper extending away from the flat bottom wall 36 portion in opposite directions toward the aperture 10. The tapered sidewalls 31 are symmetrically shaped.

It is noted that that there may be a 1.0 inch metallic flange, not shown, surrounding the aperture at z=0. This flange serves dual purposes. The first is providing a mounting apparatus for any flat surface that the antenna may be embedded within. Secondly, it serves to mitigate some of the edge effects that would otherwise be seen at the aperture edges and to partially suppress some of the antenna's back radiation.

An anisotropic high index medium material 16 is at least partially loaded within the tapered cavity 50. The anisotropic high index medium material 16 is also linearly tapered using an inverse relationship to that of the width of the cavity walls. Initially, the relative permittivity and relative permeability tensors for the anisotropic material are given by:

$$\underline{\underline{\varepsilon_r}} = \begin{bmatrix} \varepsilon_x & 0 & 0 \\ 0 & \varepsilon_y & 0 \\ 0 & 0 & \varepsilon_z \end{bmatrix} \quad \underline{\underline{\mu_r}} = \begin{bmatrix} \mu_x & 0 & 0 \\ 0 & \mu_y & 0 \\ 0 & 0 & \mu_z \end{bmatrix}. \tag{2}$$

Here, a(z) changes to maintain $f_r$ dependent on the width of the high index material at point z in the cavity. The rectangular probe is located at z=−δ+0.08".

In this design, $a_0$ serves the same purpose as a in FIG. 1, where $f_r$=200 MHz and w(z)=0 at point z=0. Dimension $a_1$ represents the value of $\lambda_r/2$ that maintains $f_r$=200 MHz when the transverse plane of the rectangular cavity is completely filled with the high index medium material and $w=\lambda_r/(2\sqrt{\epsilon_r\mu_r}$. The shape of the rectangular cavity is determined by a straight line between these points ($a_0$, z=0) and ($a_1$, z=−d). This is only an initial approximation to the shape of the tapered rectangular cavity loaded with anisotropic material.

The quantity δ is the distance between the top of the high index material and the antenna aperture. Ideally, the material would end in a tip with infinitesimal width, but this type of structure cannot be resolved in a numerical model.

Table 2 gives the dimensions corresponding to FIG. 3 for the antenna models analyzed in this section. All cases in this table are for anisotropic materials. The $f_r$ has been reduced to 192.5 MHz because the behavior in a rectangular cavity can be unpredictable directly at the resonance frequency $f_r$. In practice, it is best to lower $f_r$ to a value below the desired frequency of operation. PW has been reduced to be the same width as the top of the dielectric material. This was initially thought to provide the smoothest impedance transition from the high index material to free space. The dimensions in the table are in inches for the simulations run for the geometry in FIG. 3.

TABLE 2

| run | $a_0$ | $a_1$ | b | $f_r$ | d | δ | PW | L | $e_y$ | $u_z$ |
|---|---|---|---|---|---|---|---|---|---|---|
| 3 | 30.68" | 9.7" | $a_0$/2.25 | 192.5 MHz | 4.07" | 0.27" | 0.7" | 8.5" | 10 | 1 |
| 5 | 30.68" | 3.1" | $a_0$/2.25 | 192.5 MHz | 1.21" | 0.27" | 0.7" | 8.5" | 10 | 10 |
| 7 | 30.68" | 9.7" | $a_0$/2.25 | 192.5 MHz | 4.07" | 0.27" | 0.7" | 8.5" | 3.16 | 3.16 |
| 8 | 30.68" | 6.1" | $a_0$/2.25 | 192.5 MHz | 2.47" | 0.27" | 0.7" | 8.5" | 5 | 5 |

Figure 4:
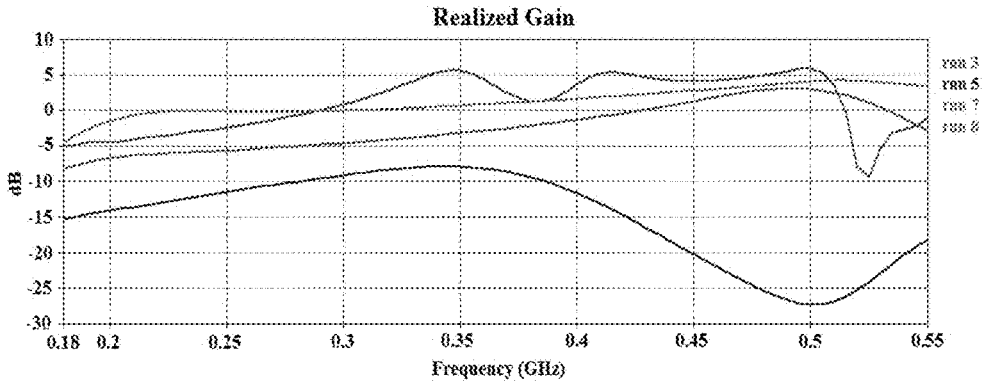
FIG. 4 depicts simulation results for the antenna model in FIG. 3 loaded with anisotropic high index medium materials with the values listed in Table 2, where FIGS. 4(*a*) and 4(*b*) show plots of (a) realized gain, and (b) return loss (|S11|), respectively.
Figure 4:
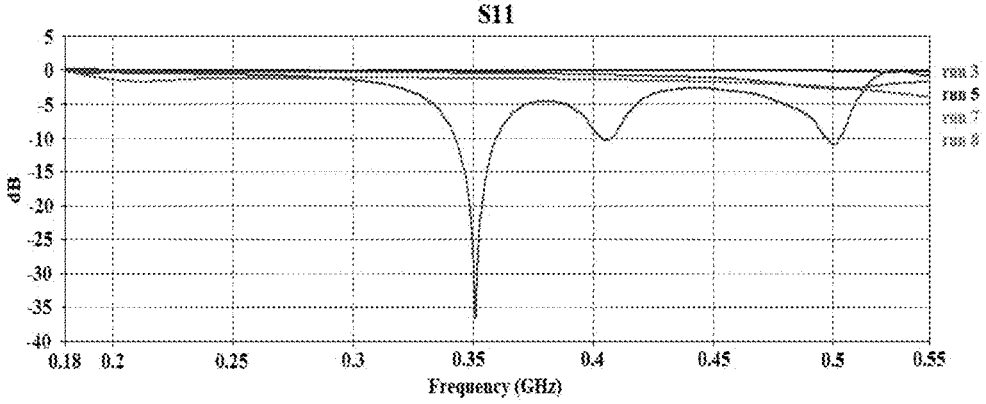

Next anisotropic materials were evaluated for use in the antenna. FIGS. 4(*a*) and 4(*b*) show the realized gain and return loss (S11) curves for anisotropic materials with values listed in Table 2 for the antenna model of FIG. 3 for Runs 3, 5, 7 and 8. It is apparent, that these initial results do not yield very promising performance, and actually the Run 3 case represents the best performance of the group. While these results are not very good, they represent the inventors' first attempt to incorporate anisotropic materials into the antenna design.

Run 3, in these plots, shows stable results in the VSWR and realized gain. For the dielectric material, from 290 MHz-515 MHz there is a positive realized gain even though the S11 is not particularly good over the entire range. At 350 MHz, there is a narrowband match of better than −40 dB corresponding to the peak realized gain of about 5.8 dB. This is expected since this represents approximately λ/4 separation between the ground plane and aperture at the center frequency.

The poor performance of the antenna simulations are a direct result of a poor impedance match at the input. This is demonstrated in FIG. 4(*b*) by a S>−6 dB. One potential reason for this input impedance mismatch may stem from a reactance created within the rectangular transverse resonance cavity caused by the abrupt transition from high index metamaterial to free space near the aperture. One way to counteract this would be to increase the width of the rectangular probe used to stimulate the fields inside the rectangular transverse resonance cavity.

Figure 5:
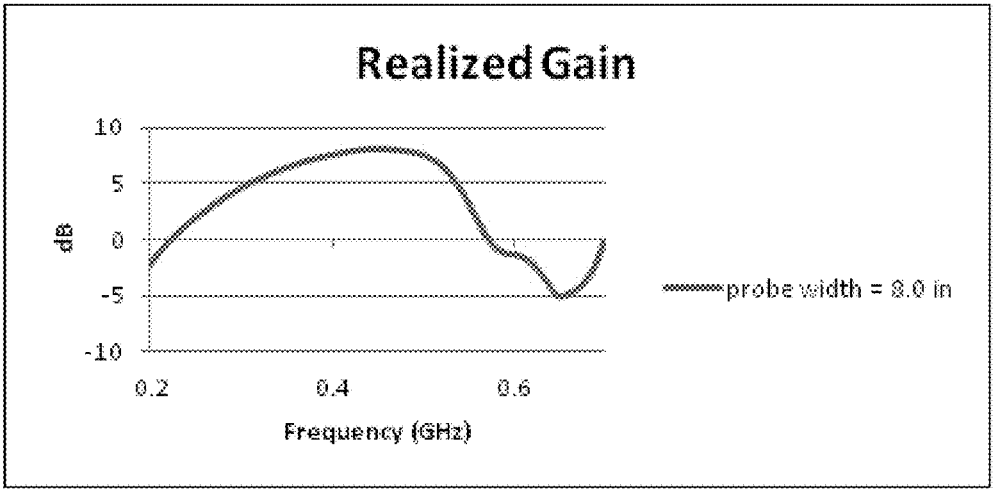
FIG. 5 shows simulation results for the antenna in FIG. 3 with the dimensions listed in Table 3, where FIGS. 5(*a*) and 5(*a*) show plots of a) realized gain and b) |S11|, respectively.
Figure 5:
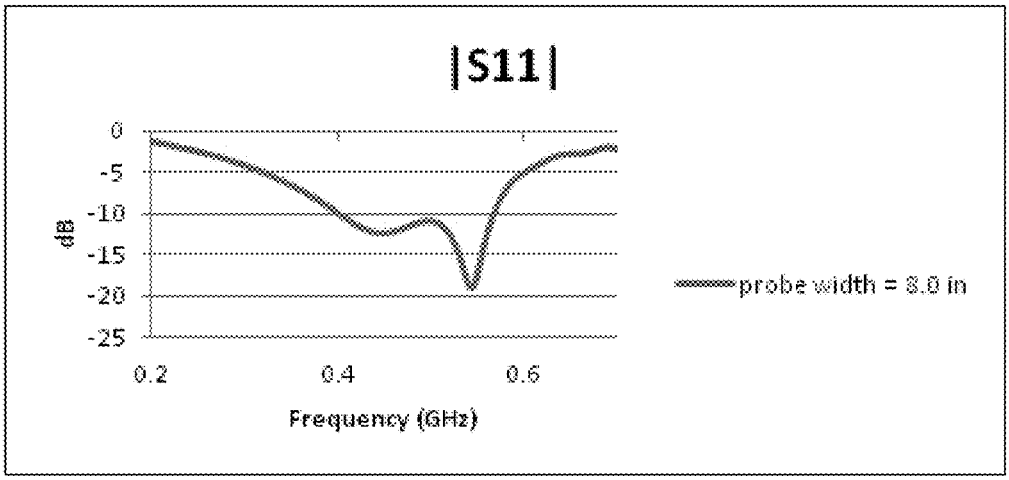

FIGS. 5(*a*) and 5(*b*) show the realized gain and |S11| curves, respectively, for the antenna model depicted in FIG. 3 with the dimensions listed in Table 3. This provides a 250 MHz bandwidth where S11<−6 dB and a 175 MHz bandwidth where the S11<−10 dB. This is a major improvement over a significant portion of the band. The realized gain remains positive from 210-585 MHz.

TABLE 3

| $a_0$ | b | $a_1$ | $f_r$ | d | δ | PW | L |
|---|---|---|---|---|---|---|---|
| 29.5" | 13.1" | 9.3" | 200 MHz | 4.2" | 0.27" | 8.0" | 8.5" |

In order to further improve the match, the inventors derived an anisotropic resonance condition which can be utilized to give the exact shape of the cavity needed to maintain a constant resonance frequency.

The previously mentioned U.S. patent application Ser. No. 14/593,292 discloses a tapered cavity based on the isotropic resonance condition. The anisotropic resonance condition is similar to the isotropic resonance condition only it is applied for anisotropic material. Specifically, the difference is in the definition of the characteristic impedance for each. The anisotropic material has directional dependent properties. The impedance for an anisotropic material may be defined $$\text{as } Z_c = \sqrt{\mu_z/\varepsilon_y}.$$

This leads to different equations for the antenna cavity using an anisotropic high index medium material 16.

In one exemplary embodiment, the anisotropic high index medium material 16 may be is fabricated by a roll to roll sputtering process in which a substrate of dielectric material is sputtered with periodic magnetic filaments. The filaments are directional dependent. The density of the filaments determines the permeability p of the anisotropic medium. The higher the density of the filaments the higher the permeability of the medium. However, the higher the permeability the higher the losses in the material in some cases. For the antenna designs in FIGS. 3, 8, 11 and 13, the amount of anisotropic high-index medium material 16 used may be about 6,947 $cm^3$ or $V=0.5*a_1*d*b$.

The derivations in this section all refer to the transmission line representation of the rectangular cavity.

Figure 6:
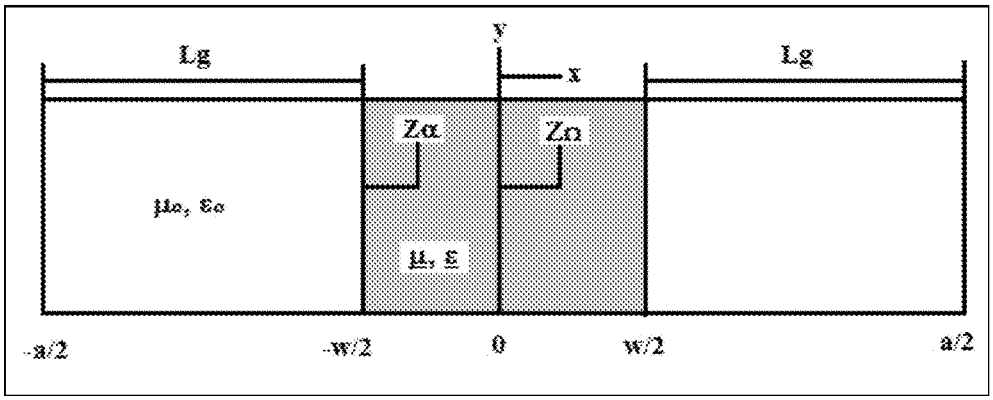
FIG. 6 illustrates the transmission line model of the rectangular antenna cavity.

FIG. 6 illustrates the transmission line model of the rectangular antenna cavity for $L_g$ vs. w. An impedance transformation establishes a symmetric transverse resonance condition at x=0.

A free space region is derived as follows. Assume Maxwell's source free equations:

$$\nabla\times\underline{E}=-j\omega\mu_o\underline{H}, \tag{3a}$$

$$\nabla\times\underline{H}=j\omega\in_o\underline{E}. \tag{3b}$$

Evaluating the curl operator of equations 3a and 3b yields the following transverse components for the electric and magnetic fields in the waveguide in terms of $H_z$ and $E_z$ $$E_x=-\frac{j}{k_o^2-k_{zo}^2}\left(\omega\mu_o\frac{dH_z}{dy}+k_{zo}\frac{dE_z}{dx}\right), \tag{4a}$$

$$E_y=\frac{j}{k_o^2-k_{zo}^2}\left(\omega\mu_o\frac{dH_z}{dx}-k_{zo}\frac{dE_z}{dy}\right), \tag{4b}$$

$$H_x=\frac{j}{k_o^2-k_{zo}^2}\left(\omega\varepsilon_o\frac{dE_z}{dy}-k_{zo}\frac{dH_z}{dx}\right), \tag{4c}$$

$$H_y=-\frac{j}{k_o^2-k_{zo}^2}\left(\omega\varepsilon_o\frac{dE_z}{dx}+k_{zo}\frac{dH_z}{dy}\right). \tag{4d}$$

To solve for $H_z$, we formulate the transverse free space wave equation from (3a) and (3b) as $$\nabla_T\times\nabla_T\times H=j\omega\varepsilon_o(\nabla_T\times\underline{E})=\nabla_T(\nabla_T\cdot\underline{H})-\nabla_T^2H_z, \tag{5}$$

$$j\omega\varepsilon_o(-j\omega\mu_oH_z)+\nabla_T^2H_z=0,$$

$$\left(\frac{d^2}{dx^2}+\frac{d^2}{dy^2}+k_o^2\right)H_z=0.$$

At the frequency $k_{zo}=0$, which allows us to calculate resonance for this structure. If we assume a $TE_{10}$-like resonance, then $k_{yo}=0$ for the first resonance, which means no variation of the fields in the y-direction. This means that $d^2H_z/dy^2=0$ and $$\frac{d^2H_z}{dx^2}+k_o^2=0, \tag{6}$$

$$\beta_o=k_o. \tag{7}$$

Solving equation 10 for $H_z$ and inserting into equation 4a-4d yields $$H_z=Ae^{-jk_ox}+Be^{-jk_ox}, \tag{8a}$$

$$E_y=\frac{j\omega\mu_o}{k_o^2}(-jk_o)(Ae^{-jk_ox}-Be^{-jk_ox})=Z_o(Ae^{-jk_ox}-Be^{-jk_ox}). \tag{8b}$$

We can see from equations 4a-4d that based on our resonance conditions on $E_k$, and $k_{zo}$ and $k_{yo}$ that $E_x=0$, $H_x=0$ and $H_y=0$.

An anisotropic region is then derived as follows. Again, we assume Maxwell's source free equations in the anisotropic region $$\nabla\times\underline{E}=-j\omega\mu_o\underline{\mu_r}\sim\underline{H}, \tag{9a}$$

$$\nabla\times\underline{H}=j\omega\in_o\underline{\in_r}\sim\underline{E}, \tag{9b}$$

where the permeability and permittivity are now defined by tensors $$\underline{\underline{\mu_r}}=\begin{bmatrix}\mu_x&0&0\\0&\mu_y&0\\0&0&\mu_z\end{bmatrix}\text{ and }\underline{\underline{\varepsilon_r}}=\begin{bmatrix}\varepsilon_x&0&0\\0&\varepsilon_y&0\\0&0&\varepsilon_z\end{bmatrix}. \tag{10}$$

Evaluating the curl operator of equations 9a and 9b yields the following transverse components for the electric and magnetic fields in the waveguide in terms of $H_z$ and $E_z$ $$E_x=-\frac{j}{k_o^2\mu_y\varepsilon_x-k_{z1}^2}\left(\omega\mu_o\mu_y\frac{dH_z}{dy}+k_{z1}\frac{dE_z}{dx}\right), \tag{11a}$$

$$E_y=-\frac{j}{k_o^2\mu_x\varepsilon_y-k_{z1}^2}\left(\omega\mu_o\mu_x\frac{dH_z}{dx}-k_{z1}\frac{dE_z}{dy}\right), \tag{11b}$$

$$H_x=\frac{j}{k_o^2\mu_x\varepsilon_y-k_{z1}^2}\left(\omega\varepsilon_o\varepsilon_y\frac{dE_z}{dy}-k_{z1}\frac{dH_z}{dx}\right), \tag{11c}$$

$$H_y=\frac{j}{k_o^2\mu_y\varepsilon_x-k_{z1}^2}\left(\omega\varepsilon_o\varepsilon_x\frac{dE_z}{dx}+k_{z1}\frac{dH_z}{dy}\right). \tag{11d}$$

To solve for $H_z$, we formulate the transverse anisotropic wave equation from (9a) and (9b)

$$\nabla_T\times\nabla_T\times\underline{H}=j\omega\varepsilon_o\underline{\underline{\varepsilon_r}}\cdot(\nabla_T\times\underline{E}), \tag{12}$$

$$\nabla_T\times\nabla_T\times\underline{H}=j\omega\varepsilon_o\underline{\underline{\varepsilon_r}}\cdot(-j\omega\mu_o\underline{\underline{\mu_r}}\cdot\underline{H}),$$

$$\nabla_T\times\underline{\underline{\varepsilon_r^{-1}}}\cdot(\nabla_T\times H)=k_o^2\underline{\underline{\mu_r}}\cdot\underline{H},$$

$$\frac{k_o^2\mu_x}{k_o^2\mu_x\varepsilon_y-k_{z1}^2}\frac{d^2H_z}{dx^2}+\frac{k_o^2\mu_y}{k_o^2\mu_y\varepsilon_x-k_{z1}^2}\frac{d^2H_z}{dy^2}+k_o^2\mu_zH_z=0.$$

Now, we set $k_{z1}=0$ which allows us to calculate resonance for this structure. Similarly, we can assume that $k_{y1}=0$ for the first resonance. This means that $d^2H_z/dy^2=0$ $$\frac{d^2H_z}{dx^2}+k_o^2\mu_z\varepsilon_y=0, \tag{13}$$

$$\beta_1=k_o\sqrt{\mu_z\varepsilon_y}. \tag{14}$$

Solving equation 13 for $H_z$ yields $$H_z=Ce^{-j\beta_1x}+De^{+j\beta_1x}, \tag{15a}$$

-continued $$E_y = \frac{jZ_o}{k_o\varepsilon_y}(-j\beta_1)(Ce^{-j\beta_1 x} - De^{+j\beta_1 x}) = Z_o\sqrt{\frac{\mu_z}{\varepsilon_y}}\,(Ce^{-j\beta_1 x} - De^{+j\beta_1 x}). \tag{15b}$$

We can see from equations 11a-11d that based on our resonance conditions on $E_z$, $k_{z1}$ and $k_{y1}$ that $E_x=0$, $H_x=0$ and $H_y=0$.

Next, we solve the boundary conditions for the Impedances in the two regions. The first boundary condition exists at the perfect electric conductor (PEC) boundary at x=−a/2 where the electric field is known to be zero $$E_y|_{x=-\frac{a}{2}} = 0 \rightarrow Ae^{jk_o\frac{a}{2}} = Be^{-jk_o\frac{a}{2}}, \quad A = Be^{-jk_o a}. \tag{16}$$

Plugging equation 16 into our equations 8a and 8b yields $$\begin{aligned} E_y &= Z_o B[e^{-jk_o x}e^{-jk_o a} - e^{+jk_o x}] \\ &= Z_o Be^{-jk_o\frac{a}{2}}\left[e^{-jk_o\left(x+\frac{a}{2}\right)} - e^{+jk_o\left(x+\frac{a}{2}\right)}\right], \\ E_y &= -2jZ_o Be^{-jk_o\frac{a}{2}}\sin\left[k_o\left(x+\frac{a}{2}\right)\right]. \end{aligned} \tag{17a}$$

Similarly, $$\begin{aligned} H_z &= Be^{-jk_o a}e^{-jk_o x} + Be^{+jk_o x}, \\ H_z &= 2Be^{-jk_o\frac{a}{2}}\cos\left[k_o\left(x+\frac{a}{2}\right)\right]. \end{aligned} \tag{17b}$$

Now we can solve for the impedance of the free space region as $Z=-E_y/H_z$ $$Z_o = -\frac{E_y}{H_z} = jZ_o\tan\left[k_o\left(x+\frac{a}{2}\right)\right], \quad 0 \le \left(x+\frac{a}{2}\right) \le \frac{a-w}{2}. \tag{18}$$

The second boundary condition exists at x=−w/2 where the tangential fields at the boundary are equal. In this case, there are two tangential fields in $E_y$ and $H_z$. At the boundary, we have the following three conditions $$E_y^-|_{x=-\frac{w}{2}} = E_y^+|_{x=-\frac{w}{2}}, \tag{19a}$$

$$H_z^-|_{x=-\frac{w}{2}} = H_z^+|_{x=-\frac{w}{2}}, \tag{19b}$$

$$Z_o|^-_{x=-\frac{w}{2}} = Z_1|^+_{x=-\frac{w}{2}}. \tag{19c}$$

Plugging equations 15a and 15b into 19a and 19b yields the following set of equations $$-2jBe^{-jk_o\frac{a}{2}}\sin\left[k_o\left(\frac{a-w}{2}\right)\right] = \sqrt{\frac{\mu_z}{\varepsilon_y}}\left(Ce^{-j\beta_1\frac{w}{2}} - De^{+j\beta_1\frac{w}{2}}\right), \tag{20}$$

$$2Be^{-jk_o\frac{a}{2}}\cos\left[k_o\left(\frac{a-w}{2}\right)\right] = Ce^{-j\beta_1\frac{w}{2}} - De^{+j\beta_1\frac{w}{2}}. \tag{21}$$

This gives us two equations to solve for three unknowns. In order to solve for the third unknown, we can match equation 18 to the impedance in the anisotropic region at x=−w/2. Again we solve for $Z=-E_y/H_z$ from equations 17a and 17b $$Z_1 = Z_o\sqrt{\frac{\mu_z}{\varepsilon_y}}\left[\frac{De^{+j\beta_1 x} - Ce^{-j\beta_1 x}}{De^{+j\beta_1 x} + Ce^{-j\beta_1 x}}\right] = Z_o\sqrt{\frac{\mu_z}{\varepsilon_y}}\left[\frac{1-\rho e^{-j2\beta_1 x}}{1+\rho e^{-j2\beta_1 x}}\right], \quad -\frac{w}{2} \le x \le 0, \tag{22a}$$

$$|Z_1| = Z_o\sqrt{\frac{\mu_z}{\varepsilon_y}}, \tag{22b}$$

$$\rho = \frac{C}{D}. \tag{23}$$

Now applying boundary condition 19c to equations 18 and 22

$$\begin{aligned} Z_o\sqrt{\frac{\mu_z}{\varepsilon_y}}\left[\frac{1-\rho e^{j\beta_1 w}}{1+\rho e^{j\beta_1 w}}\right] &= jZ_o\tan\left[k_o\left(\frac{a-w}{2}\right)\right], \\ \left[\frac{1-\rho e^{j\beta_1 w}}{1+\rho e^{j\beta_1 w}}\right] &= j\sqrt{\frac{\varepsilon_y}{\mu_z}}\tan\left[k_o\left(\frac{a-w}{2}\right)\right] = j\overline{X}, \\ 1-\rho e^{j\beta_1 w} &= j\overline{X} + j\overline{X}\rho e^{j\beta_1 w}, \\ 1-j\overline{X} &= j\overline{X}\rho e^{j\beta_1 w} + \rho e^{j\beta_1 w}, \\ \rho = \frac{1-j\overline{X}}{1+j\overline{X}}e^{-j\beta_1 w} &= e^{-j2\pi\sqrt{\mu_z\varepsilon_y}\frac{w}{\lambda}}\left\{\frac{1-j\sqrt{\frac{\varepsilon_y}{\mu_z}}\tan\left[\pi\left(\frac{a-w}{\lambda}\right)\right]}{1+j\sqrt{\frac{\varepsilon_y}{\mu_z}}\tan\left[\pi\left(\frac{a-w}{\lambda}\right)\right]}\right\}. \end{aligned} \tag{24}$$

Substituting equation 24 into 23 gives us our third equation along with equations 20 and 21 to solve for the three unknowns B, C and D.

We can now solve the transverse resonance condition. If we view FIG. 6 as a transmission line representation of our problem, we can solve for $L_g$ in terms of w for a given wavelength (λ). For instance, at 200 MHz, $\lambda_o$=1.5 m. We can use the input impedance transformations of transmission line theory to calculate $\vec{Z}_{in}$ at x=0. Then by symmetry the transverse resonance condition simplifies to $\vec{Z}_{in}=0$ or $\vec{Y}_{in}=0$.

Starting at x=−a/2, we can calculate $\vec{Z}_{in}$ at x=−w/2 by $$\vec{Z}_a = jZ_o\tan[k_o L_g]. \tag{25}$$

We can now calculate $\vec{Z}_{in}$ at x=0 as $$\vec{Z}_\Omega = Z_1\frac{\vec{Z}_\alpha + jZ_1\tan\left(\beta_1\frac{w}{2}\right)}{Z_1 + j\vec{Z}_\alpha\tan\left(\beta_1\frac{w}{2}\right)}. \tag{26}$$

The transverse resonance condition simplifies equation 26 to $$Z_1 + j\vec{Z}_\alpha\tan\left(\beta_1\frac{w}{2}\right) = 0. \tag{27}$$

Plugging equations 22b and 24 into equation 27 yields the following equation for $L_g$ $$Z_o\sqrt{\frac{\mu_z}{\varepsilon_y}} - Z_o\tan(k_oL_g)\tan\left(k_o\sqrt{\mu_z\varepsilon_y}\,\frac{w}{2}\right) = 0, \tag{28}$$

$$\frac{L_g}{\lambda} = \frac{1}{2\pi}\tan^{-1}\left[\frac{\sqrt{\frac{\mu_z}{\varepsilon_y}}}{\tan\left(\frac{\pi w}{\lambda}\sqrt{\mu_z\varepsilon_y}\right)}\right].$$

For the isotropic case, $L_g$ depended on both $\mu_r$ and $\in_r$ which means all six permittivity and permeability tensor elements affected the return loss of the antenna. Ultimately the permeability value in the direction of the magnetic field at the aperture is what determines the best return loss for our antenna in FIG. 3. Now we see that as we change this tensor value ($\mu_x$), there will be no effect on the taper of the cavity.

Figure 7:
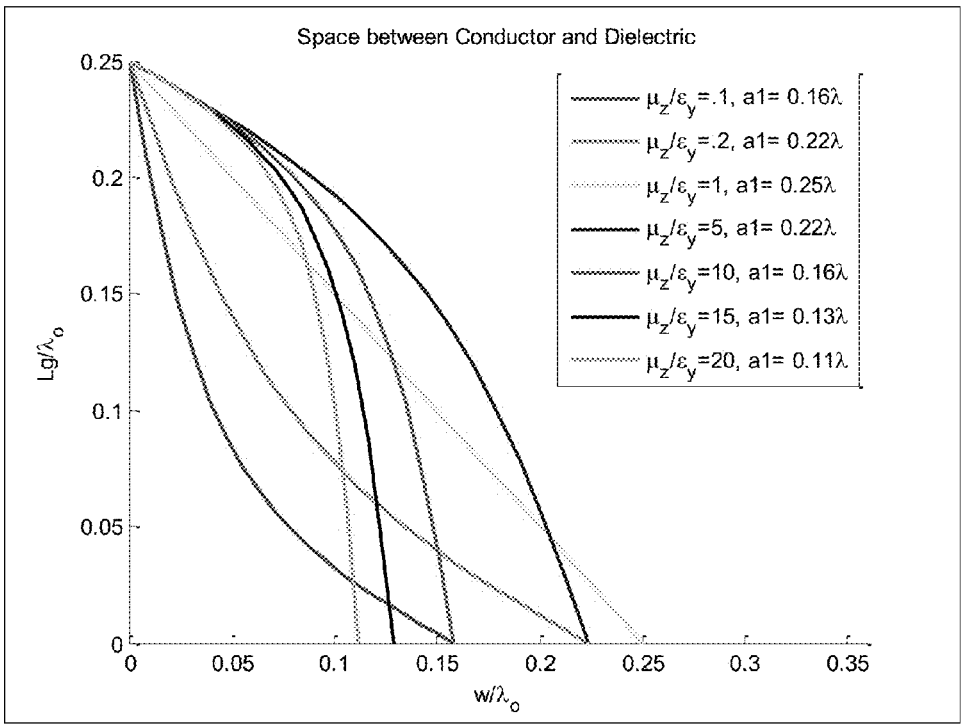
FIG. 7 depicts plots of the relationship between the ratio of $\mu_z/\in_y$ and the shape of the cavity for equation 28.

FIG. 7 depicts plots of the relationship between the ratio of $\mu_z/\in_y$ and the shape of the cavity for equation 28. A depth of 3.3 inches was assumed. Note that for a ratio of 1 we have a purely linear taper.

Looking at these plots, it is quite apparent that the cavity taper has an inverse-like relationship for when the ratio is positive versus when the ratio is negative. This stems directly from the numerator of equation 28. From these plots, it should be appreciated that the cavity may have a linear tapering, concave tapering or convex tapering according to various embodiments of the present invention.

Now that we have an explicit expression for the cavity taper based on anisotropic permittivity and permeability, we will apply it to out antenna design in FIG. 3 to see if we can further optimize the performance. The linear tapering is just a specialized case of the equation. For instance, if $\in_r = \mu_r \neq 1$ then the antenna would have a linear taper. This is depicted as the $\mu_r/\in_r = 1$ curve of FIG. 7. The linear taper would look similar to the antenna design shown in FIG. 3. However, it is important to point out that the antenna design of FIG. 3 was not specifically designed according to equation 28. It was simply an approximation that we used as part of the investigation process. If both $\mu_r = 1$ and $\in_r = 1$, then there will be no taper because this represents a rectangular cavity filled with air and no high index medium exists. This condition is what is shown in FIG. 1.

It is noted that the previously mentioned U.S. patent application Ser. No. 14/593,292 discloses a various tapered cavity based on the isotropic resonance condition also including linear, concave and convex tapers. The cavity design for anisotropic resonance condition will be similar.

Figure 8:
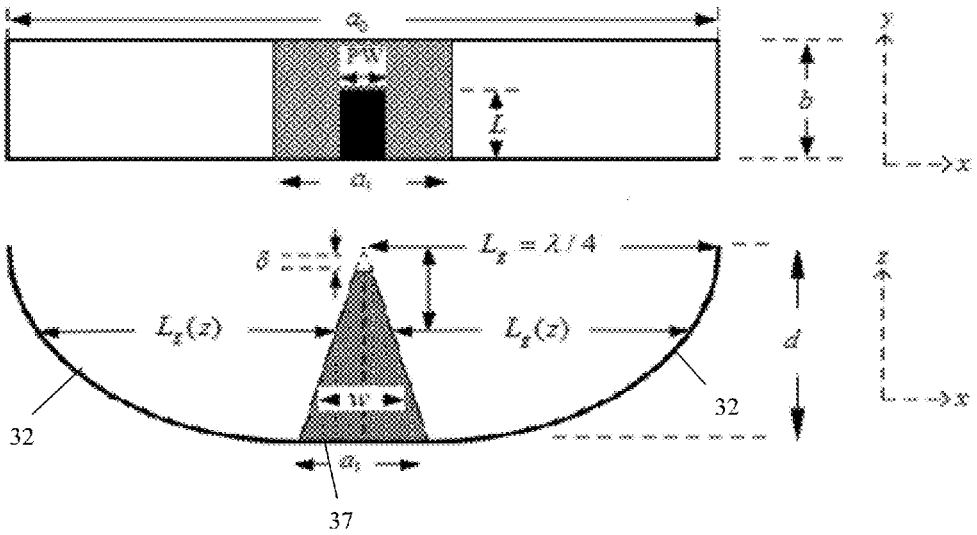
FIG. 8 is an illustration of an antenna having a concave tapered cavity partially loaded with anisotropic high index medium material, where FIG. 8(*a*) shows a top plan view, FIG. 8(*b*) shows a side view, FIG. 8(*c*) shows an isometric view of the antenna.
Figure 8:
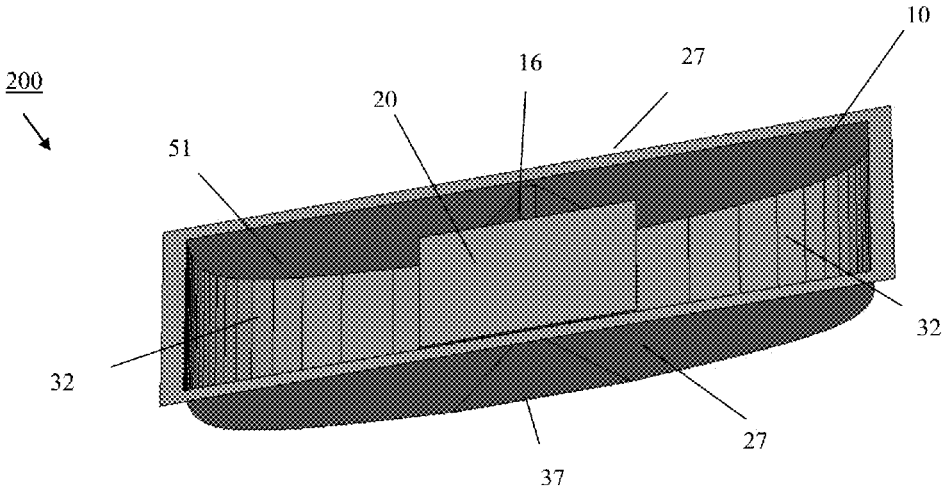

FIG. 8 is an illustration of an antenna 200 having a concave tapered cavity 51 partially loaded with anisotropic high index medium material 16, where FIG. 8(*a*) shows a top plan view, FIG. 8(*b*) shows a side view, FIG. 8(*c*) shows an isometric view of the antenna.

The convex tapered antenna cavity 51 is formed of a pair of spaced-apart longitudinal (long) sidewalls 27, a pair of spaced-apart laterally-tapered (short) sidewalls 32, and the flat bottom wall 37. The cavity 51 has an overall length $a_0$ and width b with the flat bottom wall 37 having a length $a_1$ and the tapered sidewalls 32 tapering in such a way as to maintain a nearly constant $f_r$. The width b is constant. As apparent, the tapered sidewalls 32 have a concave taper extending away from the flat bottom wall 37 portion in opposite directions toward the aperture 10. The tapered sidewalls 33 are symmetrically shaped. Here, the concave tapered cavity 51 has the parameter values based on equation 28 when $\mu_r/\in_r > 1$.

This section gives the first simulation results for the model depicted in FIG. 8 and the values listed in Table 4. The permeability and permittivity tensors that correspond to the results are $$\mu_r = \begin{bmatrix} 1 & 0 & 0 \\ 0 & 1 & 0 \\ 0 & 0 & 15 \end{bmatrix} \text{ and } \varepsilon_r = \begin{bmatrix} 1 & 0 & 0 \\ 0 & 1 & 0 \\ 0 & 0 & 1 \end{bmatrix}. \tag{29}$$

This initial study included a sweep to show how the behavior of the antenna changes for different cavity depths with all other dimensions staying the same.

TABLE 4

| DNO | d | 3:1 BW | Total BW |
|---|---|---|---|
| 2 | 2.0" | 440-530 MHz | 90 MHz |
| 3 | 3.0" | 370-510 MHz | 140 MHz |
| 4 | 4.0" | 310-495 MHz | 185 MHz |
| 5 | 5.0" | 275-490 MHz | 215 MHz |
| 6 | 6.0" | 250-480 MHz | 230 z |

Figure 9:
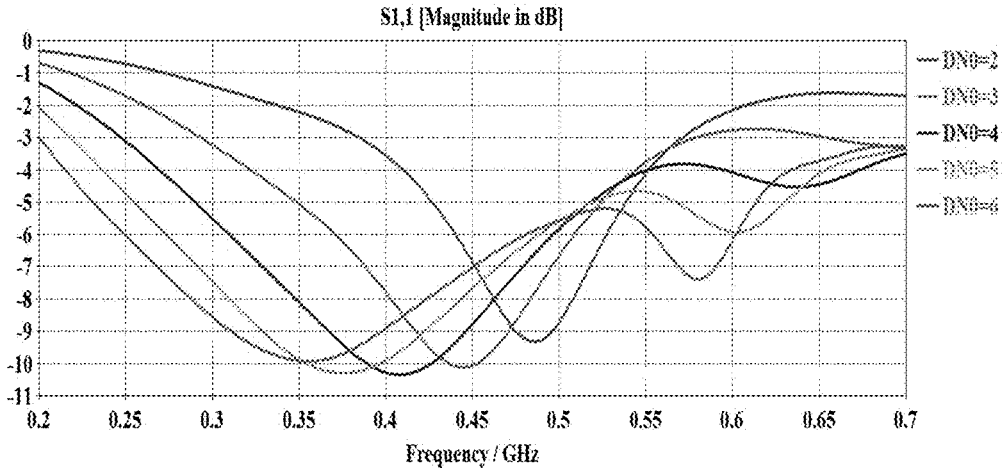
FIG. 9 shows results for the antenna in FIG. 8, where FIGS. 9(*a*) and 9(*a*) show plots of a) return loss and b) VSWR, respectively, for increasing cavity depths.
Figure 9:
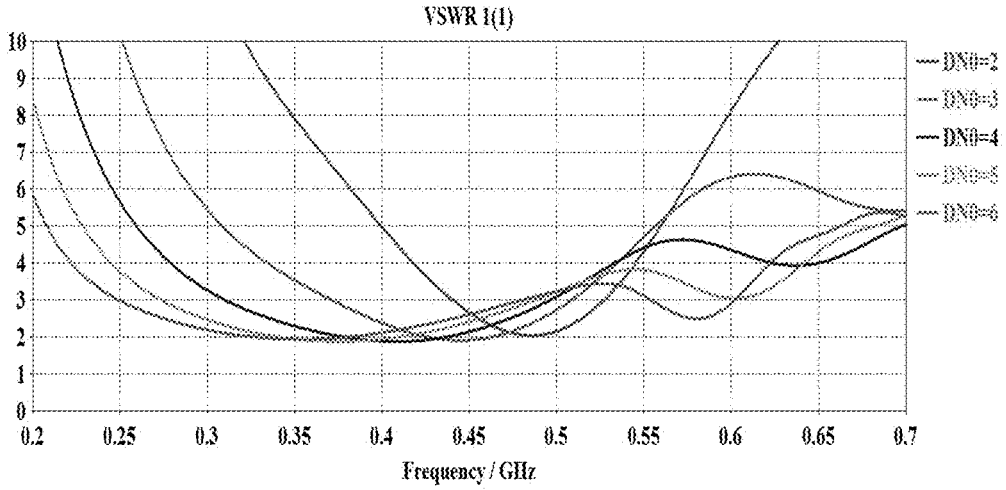

FIG. 9 shows results for the antenna in FIG. 8, where FIGS. 9(*a*) and 9(*a*) show plots of a) return loss and b) VSWR, respectively, for increasing cavity depths.

Table 4 gives the results of the operational bandwidth of the different antenna models based on a S11<−6 dB or a VSWR<3:1. The results show that as the depth increases the performance of the antenna design also improves in terms of increased bandwidth. This is expected and shows one of the phenomena that makes designing a wideband low profile antenna so difficult.

Since aligning the permeability in the direction of the magnetic field should give us the best results, a simulation of the model in FIG. 8 with the parameters listed in table 5 was performed for the following tensors of the high index medium $$\mu_r = \begin{bmatrix} 15 & 0 & 0 \\ 0 & 1 & 0 \\ 0 & 0 & 15 \end{bmatrix} \text{ and } \varepsilon_r = \begin{bmatrix} 1 & 0 & 0 \\ 0 & 1 & 0 \\ 0 & 0 & 1 \end{bmatrix}. \tag{30}$$

Table 5 provides dimensions for the simulations of the anisotropic cavity models in FIG. 8 and the tensors in equation 30.

TABLE 5

| $a_0$ | b | $a_1$ | $f_r$ | d | δ | PW | L |
|---|---|---|---|---|---|---|---|
| 29.5" | 13.1" | 9.3" | 200 MHz | 3.3" | 0.27" | 8.0" | 8.5" |

Figure 10:
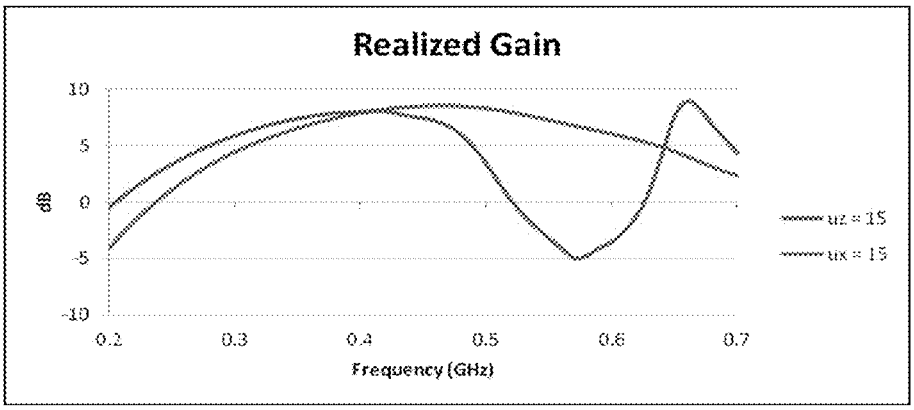
FIG. 10 shows results for the antenna in FIG. 8, where FIGS. 10(*a*) and 10(*a*) show plots of a) realized gain, b) S11, and c) VSWR, respectively, of the best results with the parameters listed in Table 5.
Figure 10:
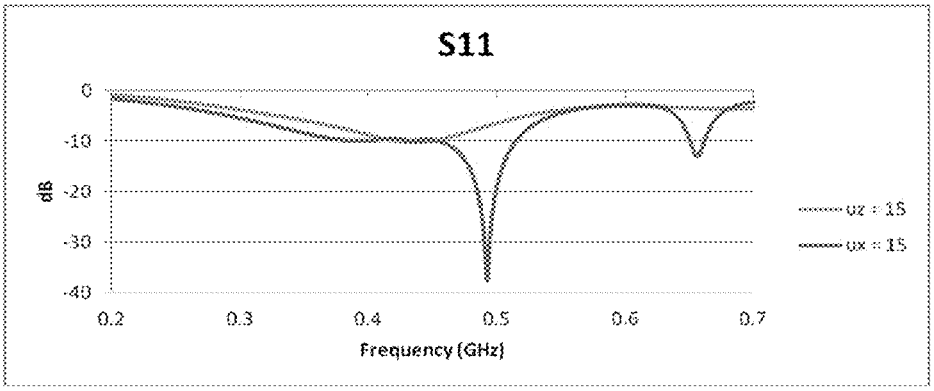
Figure 10:
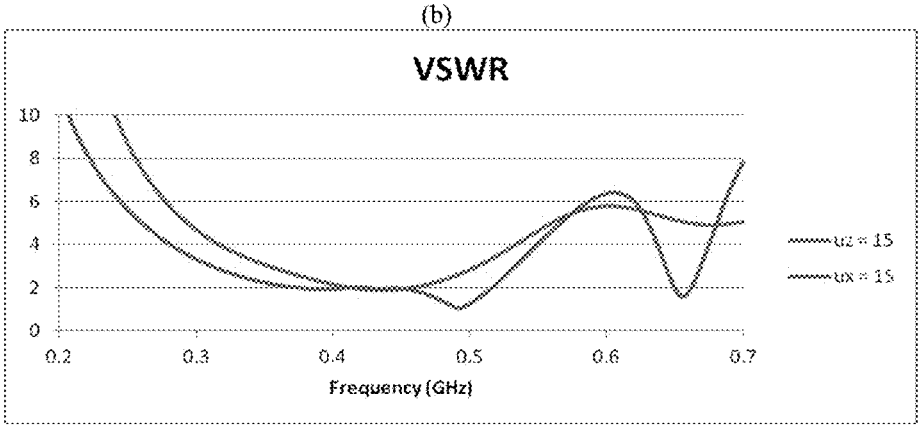

FIG. 10 shows results for the antenna in FIG. 8, where FIGS. 10(*a*) and 10(*a*) show plots of a) realized gain, b) S11, and c) VSWR, respectively, of the best results with the parameters listed in Table 5.

These plots show a drastic improvement in operational bandwidth with a lower S11 and VSWR over a wider band for the increased $\mu_x$. While there is a large drop in realized gain above 500 MHz we now maintain a positive realized gain over the entire band of interest of 200-500 MHz.

Figure 15:
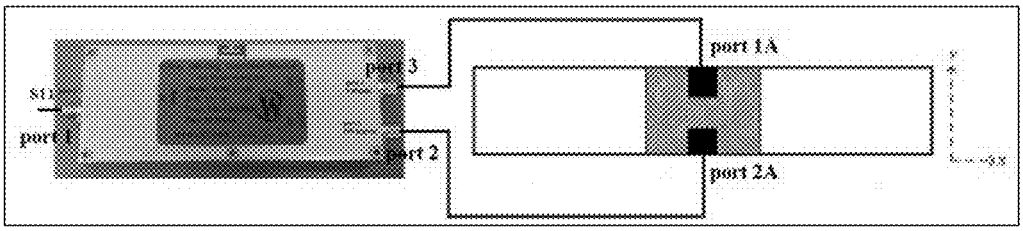
FIG. 15(*a*) shows the connectivity between the 180° coupler and the two-port antenna.
Figure 15:
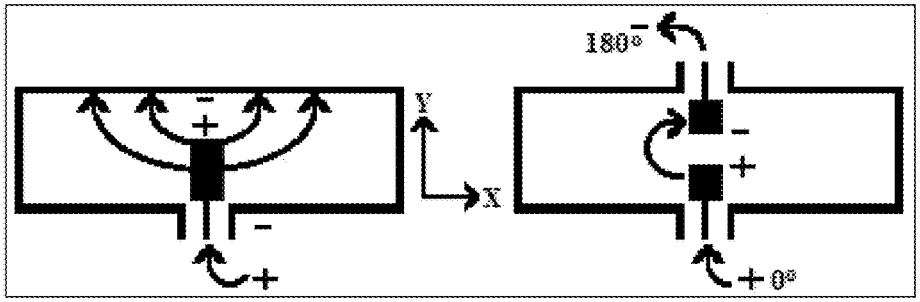

Indeed, they show excellent performance from 300-500 MHz in terms of both input impedance match and realized gain. However, the inventors desired to improve the S11 and VSWR between 200-300 MHz. All iterations and embodiments of the invention have thus far used a one-port input feed connected to a single rectangular probe. However, using a two-port input feed connected to two symmetric rectangular probes may serve to improve our input impedance match. By feeding the two ports 180° out of phase, the dual probe feed structure provides a continuous current patch from one input to the other. This manifests itself as a +/− potential difference across the two input ports as indicated in FIG. 15 This is accomplished via the phase difference because $e^{j*0}=+1$ and $e^{j*\pi}=-1$.

Figure 11:
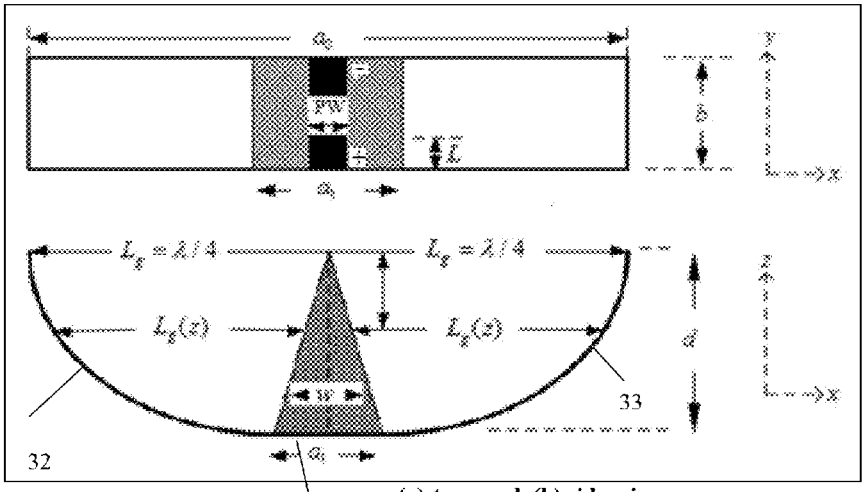
FIG. 11 is an illustration of a concave tapered cavity based on the anisotropic resonance condition and using the dual symmetric rectangular probe, where FIG. 11(*a*) shows a top plan view, FIG. 11(*b*) shows a side view, FIG. 11(*c*) shows an isometric view of the antenna.
Figure 11:
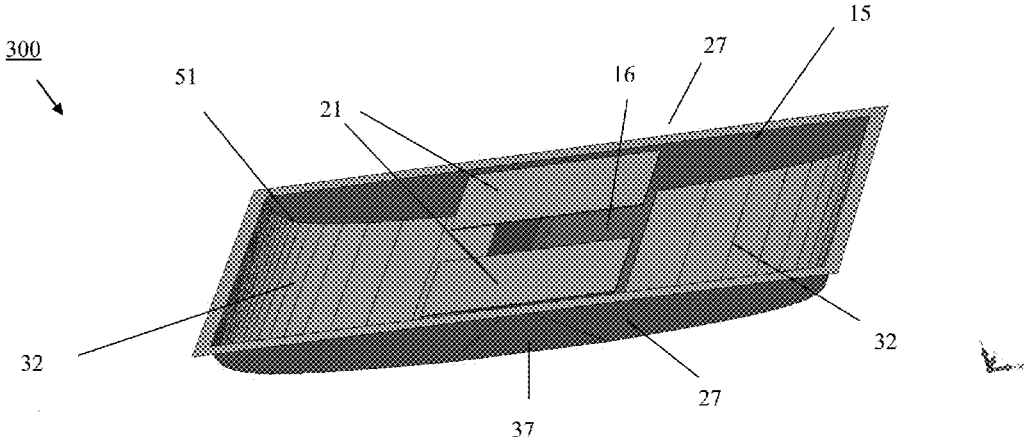

FIG. 11 is an illustration of an antenna 300 having a concave tapered cavity 51 based on the anisotropic resonance condition and using the dual symmetric rectangular probe 21, where FIG. 11(*a*) shows a top plan view, FIG. 11(*b*) shows a side view, FIG. 11(*c*) shows an isometric view of the antenna. Here, the model of the concave tapered cavity is based on equation 28 when $\mu_z/\in_y=15$ and $\mu_x=1$. The antennas illustrated in FIG. 11 is similar to the one in FIG. 8, other than that they use a two-input feed port 21 and have different design parameters as set forth in the corresponding Tables. Thus, alike elements are not further described.

Table 6 provides dimensions for the simulations of the anisotropic cavity model in FIG. 11 with the symmetric probe.

TABLE 6

| $a_0$ | B | $a_1$ | $f_r$ | d | Δ | PW | L |
|---|---|---|---|---|---|---|---|
| 39.4" | 17.5" | 10.2" | 150 MHz | 3.3" | 0.27" | 0.25b | $0.35a_0$ |

Figure 12:
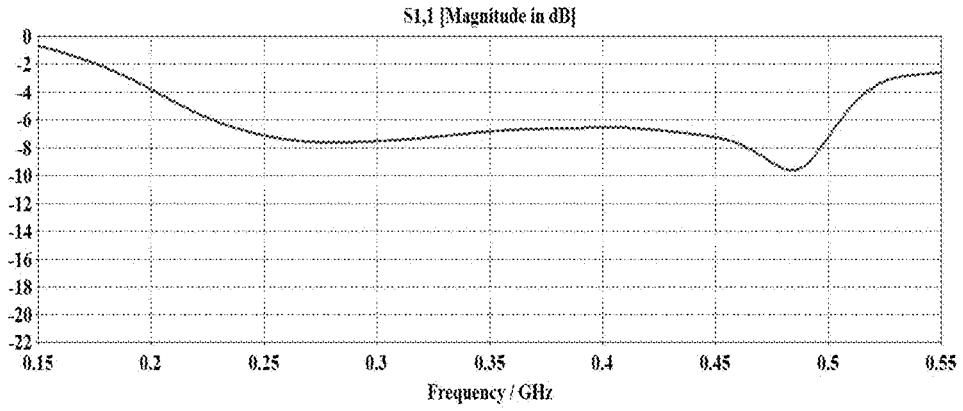
FIG. 12 shows results, where FIG. 12(*a*) shows S11, FIG. 12(*b*) shows, VSWR, and FIG. 12(*c*) shows realized gain, respectively, for the antenna model in FIG. 11 and parameter values listed in Table 6 and equation 28.
Figure 12:
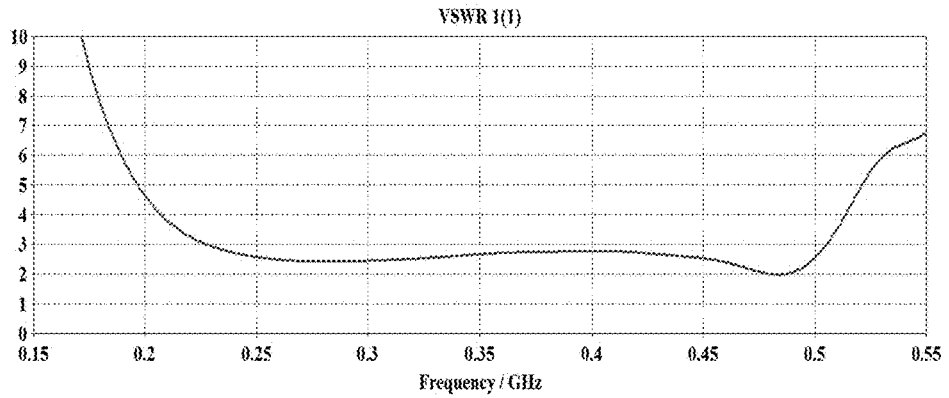
Figure 12:
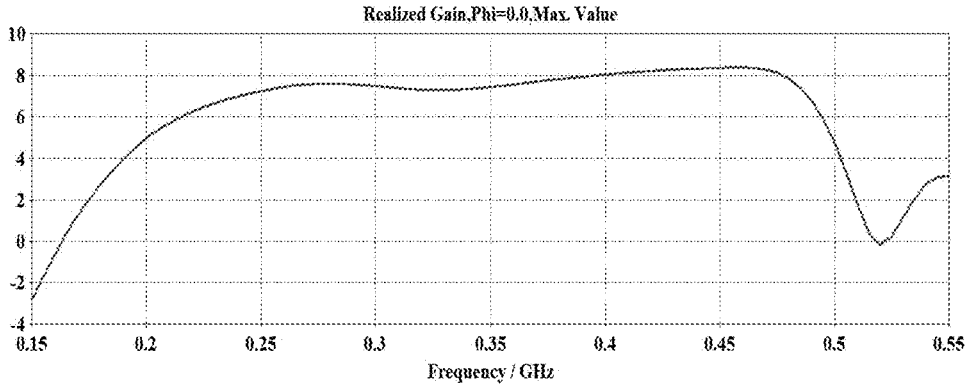

FIG. 12 shows results, where FIG. 12(*a*) shows S11, FIG. 12(*b*) shows, VSWR, and FIG. 12(*c*) shows realized gain, respectively, for the antenna model in FIG. 11 and parameter values listed in Table 6 and equation 28.

FIGS. 12(*a*)-12(*c*) show S11<−6 dB and VSWR<3:1 from 230-505 MHz and a realized gain from 200-500 MHz of 4.0-8.2 dB. We are now getting more than an octave of 3:1 VSWR with positive realized gain from 230-505 MHz. This has been accomplished both by a broadening and flattening of the S11 curve by implementing the symmetric probe as well as by shifting the entire curve down in frequency by changing $f_r$ to 150 MHz from 200 MHz. This change in $f_r$ has altered the values of $a_0$, b, $a_1$, PW, and L but has not changed the cavity depth.

The probe dimension PW and L directly affect the performance of the VSWR curve, and the values in Table 8 are optimized for broadest 3:1 VSWR bandwidth. Further improvement in the VSWR is possible at the sacrifice of bandwidth. Similarly, there is the potential to shift the frequency either up or down by changing the dimensions of $a_0$ and $a_1$. It is also important to note that further reduction in profile always comes at the expense of a degraded input impedance match.

The transverse dimensions of the aperture are based on $f_r$=150 MHz. We do not expect a good impedance match near $f_r$, and this explains why the dimensions of our aperture correspond to a much larger $\lambda_o/2$ dimension then that of our lowest desired operational frequency. This also partly explains the values obtained for the realized gain in FIG. 16(*c*) since gain is directly related to the area of the aperture. Our realized gain varies between 4-8.2 dB over 230-505 MHz. The sudden drop off seen at 475 MHz is caused by a reduction in directivity caused by a resonance in the third order mode. This destructive multi-resonance effect is clearer in the realized gain curve than in the VSWR or S11 curves.

If the total size of the planar aperture is too large we could reduce the size of the b parameter. This would reduce the realized gain, but would still maintain the same operational frequency established by a(z). We would also have to scale the probe dimension L by the same factor.

This section explores how setting $\mu_z=1$ affects the cavity shape of the antenna design. FIG. 7 suggests that a ratio of $\mu_z/\in_y=1$ will result in a linearly tapered cavity. However, for the special case of $\mu_z/\in_y=1$ where_both $\mu_z$ and $\in_y$ are unity, the walls of the cavity will not need to be tapered at all.

Figure 13:
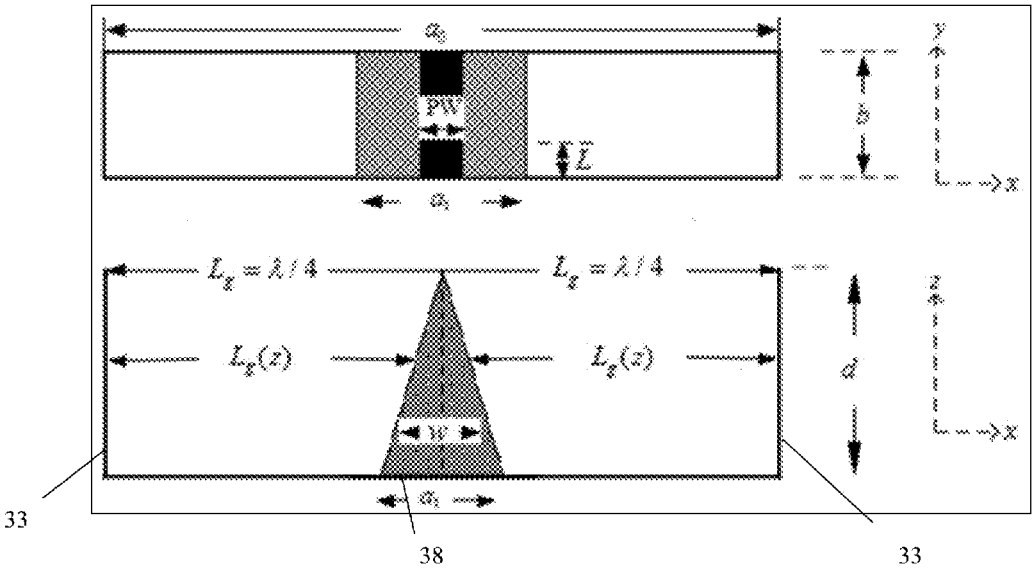
FIG. 13 is an illustration of an antenna having a rectangular cavity based on the anisotropic resonance condition and using the dual symmetric rectangular probe, where FIG. 13(*a*) shows a top plan view, FIG. 13(*b*) shows a side view, FIG. 13(*c*) shows an isometric view of the antenna.
Figure 13:
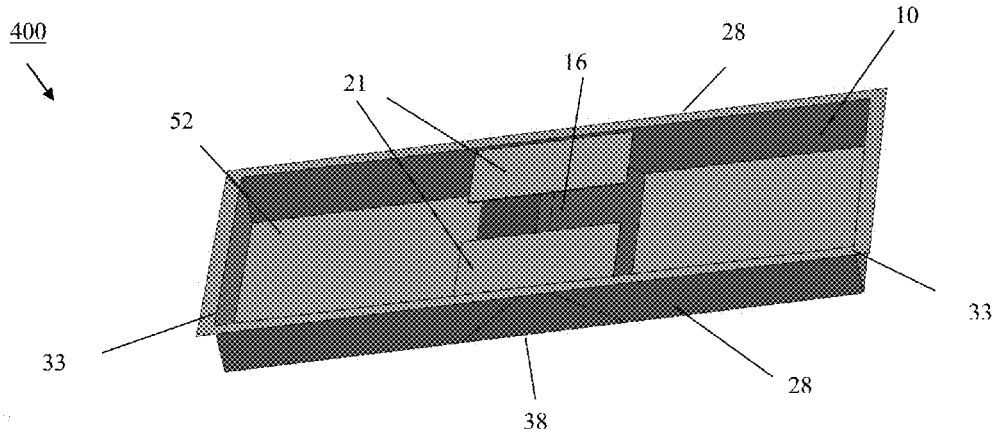

FIG. 13 is an illustration of an antenna 400 having a rectangular-shaped cavity 52 based on the anisotropic resonance condition and using the dual symmetric rectangular probe 21, where FIG. 13(*a*) shows a top plan view, FIG. 13(*b*) shows a side view, FIG. 13(*c*) shows an isometric view of the antenna. The rectangular cavity 52 geometry derived from the anisotropic transverse resonance condition with $\mu_z=1$ and $\in_y=1$. In the antenna 400, the walls 28, 33, 38 of the rectangular cavity 52 have generally perpendicular (i.e., 90°) flat interfaces forming a "box-like" structure.

The cavity geometry given by equation 28 for the following permeability and permittivity tensors $$\mu_r = \begin{bmatrix} 15 & 0 & 0 \\ 0 & 1 & 0 \\ 0 & 0 & 1 \end{bmatrix} \text{ and } \varepsilon_r = \begin{bmatrix} 1 & 0 & 0 \\ 0 & 1 & 0 \\ 0 & 0 & 1 \end{bmatrix}. \tag{31}$$

The cavity shape is a rectangular cavity with no taper, and all dimensions are the same as those in Table 6. This antenna model also utilized the dual symmetric rectangular probe. This is a very different result from those of FIGS. 8 and 11. This indicates that regardless of the anisotropic tensor values, as long as $\mu_z=1$ and $\in_y=1$ any amount of loading will result in the same cavity shape and a constant $f_r$ even at the material to free space boundary. We will now see if changing the value of $\mu_z$ from 15 to 1 has any effect on the return loss or realized gain of the antenna.

Figure 14:
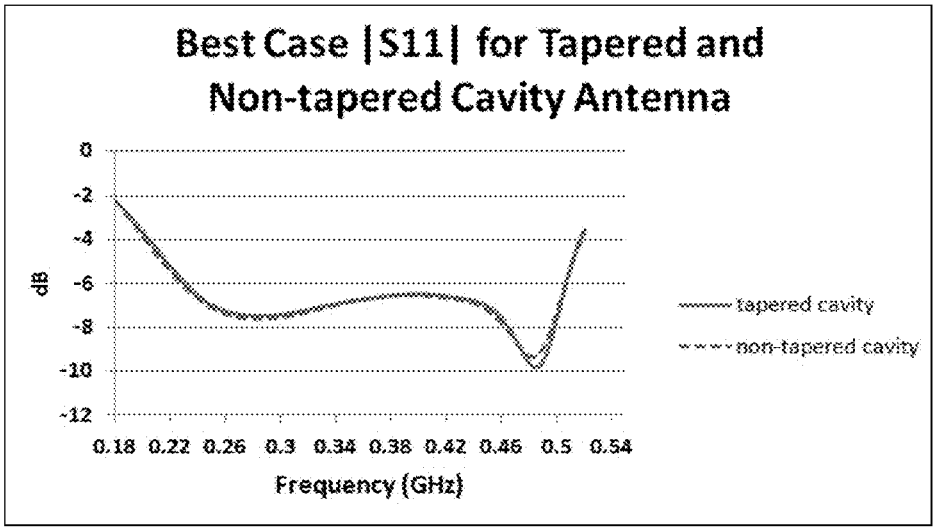
FIG. 14 shows results, where FIG. 14(*a*) shows |S11|, FIG. 14(*b*) shows VSWR, and FIG. 14(*c*) shows realized gain, respectively, for tapered and non-tapered cavity designs having the anisotropic resonance condition.
Figure 14:
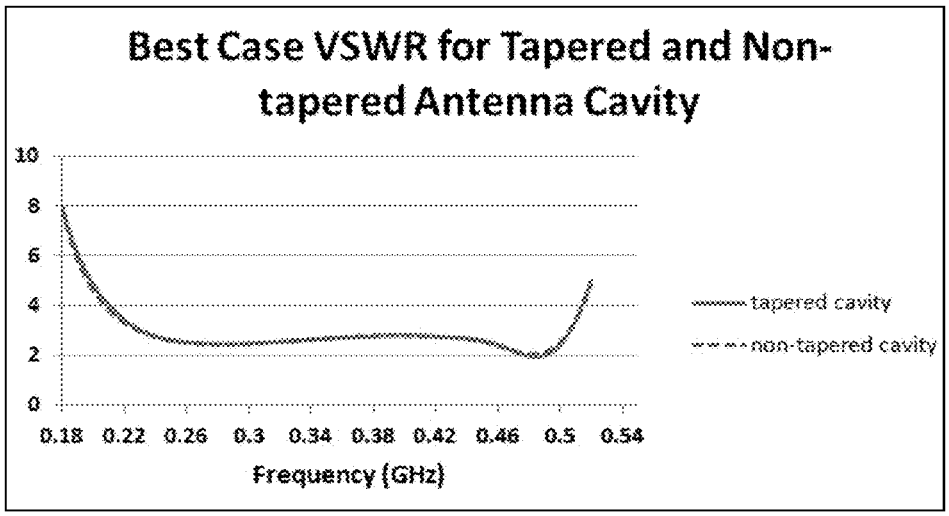
Figure 14:
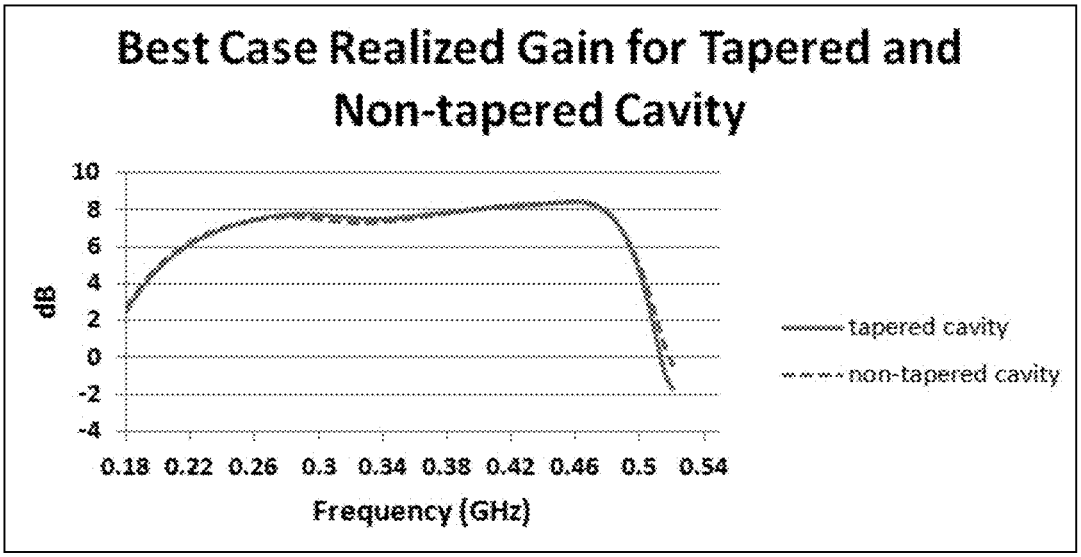

FIG. 14 shows results, where FIG. 14(*a*) shows |S11|, FIG. 14(*b*) shows VSWR, and FIG. 14(*c*) shows realized gain, respectively, for tapered and non-tapered cavity designs having the anisotropic resonance condition. The tapered plot represents the antenna model shown in FIG. 11, whereas the non-tapered plot represents the antenna model shown in FIG. 13.

For these cavity designs, the probe inputs for the tapered antenna cavity was $\mu_z=15$ and the non-tapered antenna cavity was $\mu_z=1$. Both simulations use the parameters listed in Table 6. These plots show very good agreement in the return loss, VSWR, and realized gain plots. Therefore, the inventors concluded that the non-tapered cavity shape of FIG. 13 has no noticeable effect on the overall performance of the antenna. This is a very useful result because it means the shape of the cavity can be changed to fit in different environments as long as the designer has some amount of control over the $\mu_z$ component of the permeability tensor. It also is a unique result that sets the anisotropic antenna design apart from the isotropic antenna design. Utilizing anisotropic high index medium material not only gives superior performance in terms of S11 bandwidth and realized gain, but gives the designer the freedom to manipulate the shape of the cavity at will by changing the value of $\mu_z$ without greatly affecting the antenna's performance.

The results of the symmetric probe fed antenna models of FIGS. 11 and 13 were driven in simulation using two separate waveguide ports that are 180° out of phase with an equal magnitude.

This is an optimized way to drive the antenna, but in reality we would want a feed structure with a single input port and two output ports with −3.0 dB insertion loss (this is a lossless one-half power split) as well as a 180° phase shift. The following shows the effect of using a commercial 180° hybrid coupler to provide the necessary power division and 180° phase shift needed at the input ports of the antenna.

FIG. 15(*a*) shows the connectivity between the 180° coupler and the two-port antenna. Any commercial splitter or self-designed splitter could be used, but the symmetric probe dimensions have been optimized taking this external device into account. The one used by the inventors was a Werlatone 2-Way 180° Combiner/Divider model #: H7971-102, for example. The output ports 2 and 3 of the coupler connect to the antenna input ports 1A and 2A. All antenna dimensions are consistent with Table 6. Substituting a different commercial device may require additional probe tuning. It is important to show that the antenna has been designed to connect to any 50 ohm device without degrading performance. This is very important for any commercial applications.

FIG. 15(*b*) shows the advantage of an symmetric over an asymmetric feed. A single asymmetric probe produces fringing fields over the potential difference between the probe and cavity walls (shown in the left figure). These fringing fields cause a reactance that produces a mismatch between the coaxial line and the impedance seen at the cavity aperture. This feed causes this potential difference as a result of the 180° phase shift between the inner and outer conductors of the coaxial line.

Figure 16:
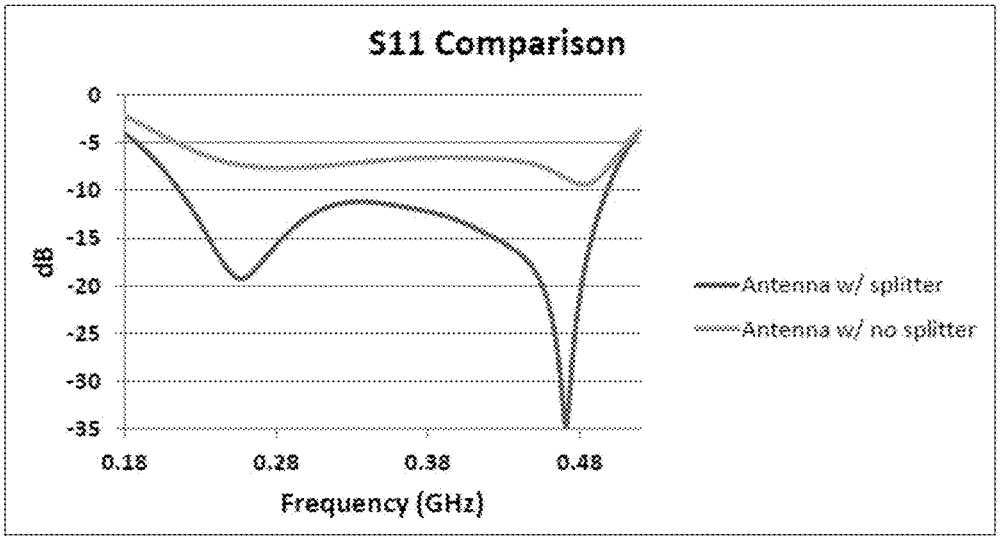
FIG. 16 show the results for the antenna shown in FIG. 13, where FIG. 16(*a*) shows S11, FIG. 16(*b*) shows VSWR, and FIG. 16(*c*) shows realized gain for the antenna.
Figure 16:
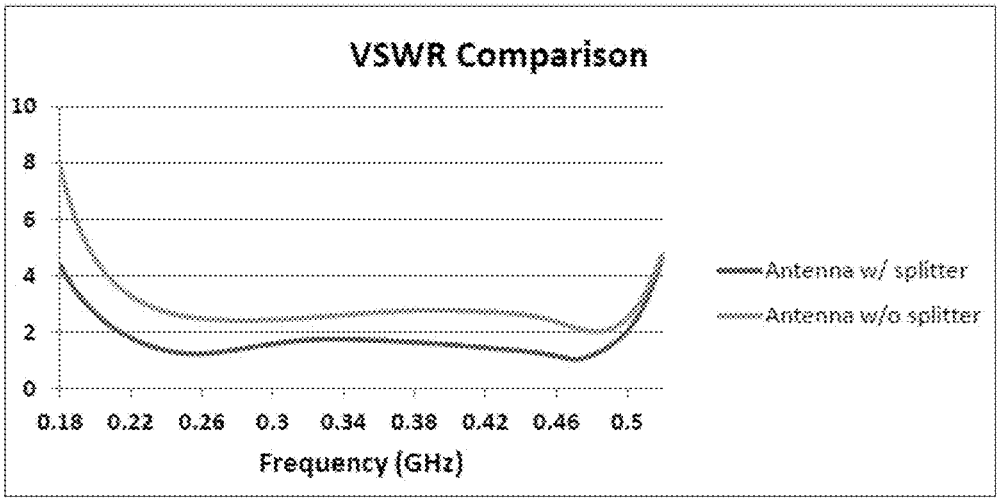
Figure 16:
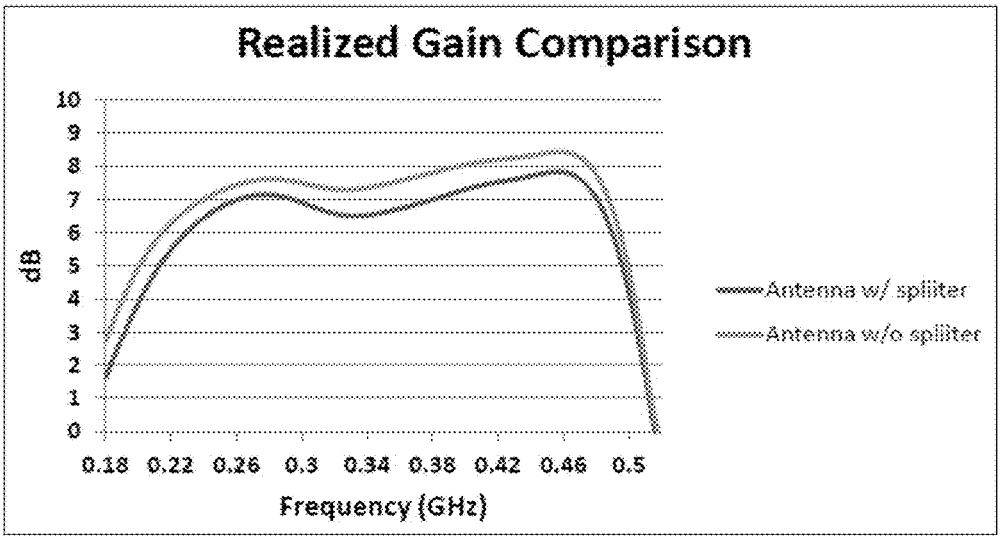

To reduce this mismatch, the inventors used a balanced feed structure which provides a continuous current path of a symmetric dual probe feed. This is shown in the right figure By feeding the two symmetric probes 180° out of phase, there is now a potential difference between the two probes providing a continuous path for the current FIG. 16 show the results for the antenna shown in FIG. 13, where FIG. 16(*a*) shows S11, FIG. 16(*b*) shows VSWR, and FIG. 16(*c*) shows realized gain for the antenna, respectively, with any without the coupler.

The plots compare the performance of the antennas shown in FIG. 13 with and without the commercial coupler to see if there is any degradation when using the commercial coupler. It should be noted that for the antenna with no coupler, the return loss is calculated at the input to port 1A in FIG. 15, and for the antenna with the coupler, the return loss is calculated at the input to port 1 in FIG. 15. There is better than a 4 dB improvement in S11 due to the presence of the coupler and up to 0.75 dB degradation in realized gain due to the added insertion loss in S21 and S31 of the coupler.

Adding a commercial 180° hybrid coupler has improved the return loss at the input to the system and increased the bandwidth with very little degradation in the realized gain. The antenna system now has better than a 2:1 VSWR from 220-505 MHz and better than a 3:1 VSWR from 200-515 MHz. The return loss of the antenna design was good enough that the 0.75 dB degradation in the return loss is due almost solely to the insertion loss of the coupler and not due to any mismatch between the output port of the coupler and the input port of the antenna.

Based on the 3:1 VSWR bandwidth with a commercial coupler attached this yields a $\lambda_o/18$ profile at 200 MHz. The fact that this antenna has over 1.5 octaves in bandwidth while achieving a constant $f_r$ while loaded with a high index medium makes it state of the art while achieving previously unseen properties in terms of multi-mode resonances within the cavity.

This invention is designed to solve the problem of the existence of high order resonances when loading an antenna cavity with a high index anisotropic medium. Having multiple resonances will tend to interfere destructively making it very difficult to achieve a good impedance match over a wide bandwidth. The existence of multiple resonances is an unavoidable consequence of waveguide theory when introducing high index materials because they lower the resonance frequency of the cavity.

Various low-profile cavity broadband antennas, according to embodiments of the present inventions, have been shown to be able to achieve a 150% bandwidth with a good impedance match at the antenna input and high realized gain in the far field radiation.

Additionally, results show that the shape of the cavity taper can be changed as needed with no degradation to the overall antenna performance through control of the permeability in the normal direction ($\mu_z$). Thus, according to an embodiment, an antenna may be designed to have a profile of d=3.3 inches ($\lambda_o/18$) at 200 MHz with $\mu_x$=15. This antenna design has more than an octave of bandwidth from 200-515 MHz. This is a 78% reduction in antenna profile compared to the traditional $\lambda_o/4$ separation between radiating element and ground plane. The design has a positive realized gain from 180-515 MHz, a 3:1 VSWR from 200-515 MHz, and a 2:1 VSWR from 220-505 MHz. Another embodiment also provides a wider band 2:1 VSWR and 0.9" reduction in profile over the isotropic antenna designs based on the same transverse resonance method. While more expensive, this additional 0.9" of profile reduction may be crucial in meeting application specifications, especially for airborne platforms.

Generally, any metallic material, such as aluminum, copper, steel or iron, etc. may be used to form the cavity in various embodiments. Different metals should not change the performance of the antenna; rather, they would only change the structural integrity and/or weight of the antenna. The primary material that governs the antenna's performance is the high index medium that is placed inside the cavity. A machine shop should be able to create a tapered cavity without needing any type of specialized equipment. For instance, five metal sides can joined together at angles. For a non-tapered cavity (e.g., FIG. 13), this could be achieved be soldering the pieces together on a bench top pretty easily. For the shape of the tapered medium, triangular blocks could be stacked together. This specific shape would not increase the cost of fabrication because we have already obtained both square and triangular blocks from the anisotropic material manufacturer at the same price. For traditional isotropic materials, they could be cut to length/size without affecting the material properties.

The various antennas embodiments may be used for various applications. For example, they may be used to covert ground point-to-point communications, provide airborne-to ground communications or airborne fixed-wing radar applications platforms where a thin profile reduces air resistance and drag, and enable mobile communication application in urban areas or other areas where overhead clearance is an issue. Additionally, they may provide improvement to broadband radar applications whether ground based or air based.

Aspects related to this innovative technology have been previously disclosed by: (i) Gregory Mitchell & Wasyl Wasylkiwskyj, in a conference presentation at the URSI National Radio Science meeting in Boulder, Colo. on Jan. 9, 2014; and (ii) Gregory A. Mitchell, in a technical report published by the U.S. Army Research Laboratory titled "Comparison of Anisotropic versus Isotropic Metamaterials in Low Profile UHF Antenna Design", ARL-TR-7012, August 2014. These disclosures are incorporated herein by reference in their entireties.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, to thereby enable others skilled in the art to best utilize the invention and various embodiments with various modifications as may be suited to the particular use contemplated.

While the foregoing is directed to embodiments of the present invention, other and further embodiments of the invention may be devised without departing from the basic scope thereof, and the scope thereof is determined by the claims that follow.

The invention claimed is:

1. A low-profile, cavity antenna comprising:

an aperture defining an opening to a cavity;

an interior space defined by the cavity which is formed of a flat bottom wall defining a ground plane, and a pair of spaced-apart, lateral sidewalk extending away from the flat bottom wall in opposite directions with an outward taper toward the aperture; and an anisotropic high index medium material, at least partially loaded within the cavity having the tapered lateral sidewalls, wherein the anisotropic high index medium material is tapered with an inverse relationship to that of the width of the tapered lateral sidewalls, such that the anisotropic high index medium material is configured to maintain a constant resonance frequency of the antenna.

2. The antenna of claim 1, wherein the anisotropic high index medium material is provided on the flat bottom wall.

3. The antenna of claim 2, wherein the anisotropic high index medium material is formed in the shape of a triangular prism.

4. The antenna of claim 1, further comprising a pair of spaced-apart, longitudinal side portions extending from opposing sides of the flat bottom wall opposite from where the lateral sidewalls extend in substantially perpendicularly direction to the aperture.

5. The antenna of claim 1, wherein the lateral sidewalls extend from opposing sides of the flat bottom wall in substantially perpendicularly direction to the aperture.

6. The antenna of claim 1, wherein the shape of the taper of the tapered lateral sidewalls is defined by a tangential equation based on both the relative permittivity ($\in_r$) and the relative permeability ($\mu_r$) of the anisotropic high index medium material.

7. The antenna of claim 6, wherein the tangential equation is defined as follows:

$$\frac{L_g}{\lambda} = \frac{1}{2\pi}\tan^{-1}\left[\frac{\sqrt{\frac{\mu_z}{\varepsilon_y}}}{\tan\left(\frac{\pi w}{\lambda}\sqrt{\mu_z\varepsilon_y}\right)}\right],$$

where $L_g$ is the length of the cavity, w is the width of the cavity, $\lambda$ is an anticipated wavelength, $\in_y$ is the relative permittivity of the anisotropic high index medium material in the length direction, and $\mu_z$ is the relative permeability of the anisotropic high index medium material in the depth direction.

8. The antenna of claim 6, wherein the taper is linear.

9. The antenna of claim 6, wherein the taper is convex.

10. The antenna of claim 6, wherein the taper is concave.

11. The antenna of claim 1, wherein the antenna is fed with a single input port.

12. The antenna of claim 1, wherein the antenna is fed with two input ports.

13. The antenna of claim 12, wherein the two input ports are symmetrically fed.

14. The antenna of claim 1, further comprising a flange surrounding the aperture.

15. The antenna of claim 1, wherein the cavity is formed of a metallic or conductive material.

16. The antenna of claim 1, wherein the antenna is configured to provide at least 1.5 octaves of bandwidth with a positive realized gain from about 200-515 MHz.

17. A low-profile cavity antenna comprising:

a rectangular aperture defining an opening to a cavity; an interior space defined by the cavity which is formed of: a flat bottom wall defining a ground plane, a pair of spaced-apart, longitudinal sidewalls extending from opposing sides of the flat bottom wall substantially perpendicular to the aperture, and a pair of spaced-apart, lateral sidewalls being symmetric and extending with an outward taper toward the aperture from opposing sides of the flat bottom wall on opposite from where the longitudinal sidewalls extend; and an anisotropic high index medium, at least partially loaded within the cavity having the tapered lateral sidewalls, wherein the anisotropic high index medium material is tapered with an inverse relationship to that of the width of the tapered lateral sidewalls, such that the anisotropic high index medium material is configured to maintain a constant resonance frequency of the antenna.

18. The antenna of claim 1, wherein the anisotropic high index medium material comprises a magneto-dielectric material.

19. A method for determining the shape of a low-profile, cavity antenna having an aperture defining an opening to a cavity; an interior space defined by the cavity formed of a flat bottom wall defining a ground plane, and a pair of spaced-apart, lateral sidewalls extending away from the flat bottom wall in opposite directions toward the aperture; and an anisotropic high index medium material, at least partially loaded within the cavity, which is configured to maintain a constant resonance frequency of the antenna, the method comprising:

selecting the anisotropic high index medium material having a relative permittivity ($\in_r$) and a relative permeability ($\mu_r$); and determining a taper of the pair of spaced-apart, lateral sidewalls based on the relative permittivity ($\in_r$) and the relative permeability ($\mu_r$) of the selected anisotropic high index medium material, wherein the anisotropic high index medium material is tapered with an inverse relationship to that of the width of the tapered lateral sidewalls, such that the anisotropic high index medium material in order to maintain a constant resonance frequency of the antenna.

20. The method of claim 19, wherein the shape of the taper of the lateral sidewall dimensions is determined using by the following equation:

$$\frac{L_g}{\lambda} = \frac{1}{2\pi}\tan^{-1}\left[\frac{\sqrt{\frac{\mu_z}{\varepsilon_y}}}{\tan\left(\frac{\pi w}{\lambda}\sqrt{\mu_z\varepsilon_y}\right)}\right],$$

where $L_g$ is the length of the cavity, w is the width of the cavity, $\lambda$ is an anticipated wavelength, $\in_y$ is the relative permittivity in the length direction, and $\mu_z$ is the relative permeability in the depth direction.

21. The method of claim 20, wherein, based on the equation, the lateral sidewalls have:

(i) no taper where $\mu_z/\in_y=1$ and $\mu_z \in_y=1$;

(ii) a linear taper where $\mu_z/\in_y=1$ and $\mu_z \in_y\neq 1$;

(iii) a concave taper where $\mu_z/\in_y>1$ and $\mu_z \in_y>1$; or (iv) a convex taper where $\mu_z/\in_y<1$ and $\mu_z \in_y>1$.

* * * * *